US005676889A

United States Patent [19]

Belgin

[11] Patent Number: 5,676,889

[45] Date of Patent: Oct. 14, 1997

[54] APPARATUS FOR AERATING AND MIXING LIQUIDS AND/OR GASES

[75] Inventor: Michael F. Belgin, Satellite Beach, Fla.

[73] Assignee: Somerset Electronics, Inc., Satellite Beach, Fla.

[21] Appl. No.: 437,645

[22] Filed: May 9, 1995

[51] Int. Cl.[6] ..... B01F 3/04

[52] U.S. Cl. ..... 261/93; 43/57; 261/121.2

[58] Field of Search ..... 261/93, 121.2; 43/57

[56] References Cited

U.S. PATENT DOCUMENTS

| | | | |
|---|---|---|---|
| 2,293,183 | 8/1942 | Walker | 261/93 |
| 2,590,581 | 3/1952 | Shirley | 261/121.2 |
| 3,053,390 | 9/1962 | Wood | 261/93 |
| 3,189,334 | 6/1965 | Bell | 261/121.2 |
| 3,278,170 | 10/1966 | Moritz | 261/93 |
| 3,279,768 | 10/1966 | Niewiarowicz | 261/93 |
| 3,393,802 | 7/1968 | Logue et al. | 261/93 |
| 3,691,230 | 9/1972 | Wesselingh | 261/93 |
| 3,904,393 | 9/1975 | Morse | 261/121.2 |
| 4,437,765 | 3/1984 | Seeger | 261/93 |
| 5,077,932 | 1/1992 | Hertherington | 261/121.2 |

FOREIGN PATENT DOCUMENTS

| | | | |
|---|---|---|---|
| 48730 | 5/1934 | Denmark | 261/93 |
| 548664 | 10/1942 | United Kingdom | 261/93 |

OTHER PUBLICATIONS

Marks, Mechanical Engineer's Handbook, 1951, McGraw Hill Co., pp. 1968–1975.

*Primary Examiner*—Tim R. Miles

[57] ABSTRACT

An apparatus for aerating and mixing liquids and gases that includes a hollow housing, at least one rotating object, rotating apparatus for rotating the rotating object, a shaft, and at least one adjustably positioned conduit tube. The hollow housing has a hollow housing first portion and a hollow housing second portion. The hollow housing first portion has a hollow housing first portion wall that contains at least one hollow housing first portion wall inflow port and the hollow housing second portion has a hollow housing second portion wall that contains at least one hollow housing second portion wall outflow port. The at least one rotating object is located in the hollow housing second portion and has a rotating object low pressure side. The rotating apparatus rotates the at least one rotating object and is located in the hollow housing first portion. The shaft connects the at least one rotating object to the rotating apparatus. And, the at least one adjustably positioned conduit tube passes through the at least one hollow housing first portion wall inflow port and has a conduit tube first end located external to the hollow housing and a conduit tube second end located in the rotating object low pressure side so that upon rotation of the at least one rotating object a substance can be drawn from the conduit tube first end to the rotating object low pressure side.

26 Claims, 16 Drawing Sheets

APPARATUS FOR AERATING AND MIXING LIQUIDS AND/OR GASES

BACKGROUND OF THE INVENTION

1. Field of the Invention

The present invention relates to mixing and aeration. More particularly, the present invention relates to mixing liquids and gases and aeration of liquids to maintain aquatic life, treatment of waste liquids either through aeration or neutralization and mixing, rapid biological growth through oxygenation, various teaching forms to illustrate the affects of vortices, and utilizing liquid dynamics to demonstrate cyclonic affects, aeration, propulsion, and hydroponics.

2. Description of the Prior Art

The aquarium industry and the fishing industry use similar aerators that include diaphragm, piston, and bilge pump types.

One prior art aerator is an expensive motor driven sprayer that provides a fine spray of water to achieve aeration. The unit is powered by a 6 volt or 12 volt DC motor which turns a spraying disk. The unit is prone to the harmful results of electrical contacts exposed to the corosive effects of fresh and salt water and humidity.

In piston and diaphragm air pump aerators, a motor actuates a piston or flexible shaft. The air is pumped by the piston or diaphragm pump through a flexible hose to an air stone which outputs a stream of small bubbles. These bubbles rise to the surface and are constrained to a small volume of the water. The rising air bubbles create minimal circulation in the water. When used for aerating bait tanks, the bait fish and shrimp become closely packed near the air bubble stream in an attempt to obtain the aerated water. Swimming bait fish cause circulation of the water by their swimming motion. However, shrimp tend to be rather sedentary, when not disturbed, and are adversely affected by the lack of circulation of aerated water. The shrimp located farthest from the bubble stream are more adversely affected by the lack of circulation and aeration.

One prior art pump is a motor driven piston air pump that is housed in a molded plastic case. An elastomer seal is used to seal off the motor and piston assembly from the battery area. The battery area is sized for 2 D size alkaline batteries. The piston draws moist air into the motor/piston area and can create the corrosion of the soldered leads on the motor, the motor case, the internal parts of the motor, and exposed copper wires. The motor shaft is connected to the wrist pin of the piston by a plastic part. The plastic part often breaks and the piston becomes disconnected from the motor. The battery contacts corrode and increase contact resistance. As the contact resistance increases, the battery drops significant voltage across the resistance and the motor does not provide sufficient thrust to generate large quantifies of bubbles. Battery terminal wires (exposed copper) corrode and at first cause a high resistance and then eventually an open circuit and the motor ceases to function. The metal spring contacts corrode and the contact resistance increases which adversely affects the battery duration. The contact resistance can increase to effectively cause an open circuit and the unit will not function.

Aerator pumps (often referred to as air "pumps") that are made in Hong Kong, China, or Taiwan are characterized by very cheap parts which corrode quickly and are prone to failure in short times (estimated at less than 6 months) in either humid or salt environments.

An example of this type of pump uses a rubber bellows that is extended and contracted by the motor mechanism to pump air through a tube to an air stone. This is a low cost unit made of inferior materials which corrode rapidly in a salt water environment. The case warps badly over a short time permitting water to condense on the internal parts. The piston draws moist air into the motor/piston area and corrodes the soldered leads on the motor, the motor case, the internal parts of the motor, and the exposed copper wires. The motor shaft is connected to the wrist pin of the piston by a plastic part. The plastic part often breaks and the piston becomes disconnected from the motor. The battery contacts corrode and increase contact resistance. As the contact resistance increase, the battery drops significant voltage across the resistance and the motor does not provide sufficient thrust to generate large quantities of bubbles. Battery terminal wires (exposed copper) corrode and at first cause a high resistance and eventually an open circuit and the motor ceases to function. The metal spring contacts corrode and the contact resistance increases and adversely affects the battery duration. The contact resistance can increase to effectively an open circuit and the unit will not function.

A typical bilge pump aerator system includes a bilge pump, a perforator plastic tube to spray water, hose fittings, and wiring. These aerators are bulky and consume space in the live bait tank or bucket. This aerator system is used with larger volumes of water in excess of 10 gallons. The problems with this type of system include corroded wire contacts and seal leaks in the bilge pump caused by overheating. The small holes in the spray down tube and the filter surrounding the bilge pump often clog with fish scales and other debris. As the back pressure on the pump increases, the current drain increases sharply and the pump overheats even though submersed in water. The bilge pump type aquarium aerators utilize AC power. The bilge pump is submersed in the aquarium water and the plastic housing is "supposedly" able to prevent the motor from shorting to the liquid. If the motor does short it would electrocute not only the aquatic life but also any person who touches the water.

A typical rotating type aerator system uses a motor to rapidly rotate a paddle which is submersed in the liquid. The collision of the paddle with the liquid generates bubbles of gases dissolved in the liquid and agitates the water so that the rapid moving water at the water-air interface absorbs more oxygen from the air. There are several models of this type of paddle agitator on the market.

Numerous innovations for mixing liquids and gases have been provided in the prior art that will be described. However, even though these innovations may be suitable for the specific individual purposes to which they address, they differ from the present invention.

FOR EXAMPLE, U.S. Pat. No. 1,556,791 to M. Henderson teaches a propeller that is provided with a hub extension that projects from the hub of the propeller. The hub extension is grooved or otherwise provided with a keying element that coacts with suitable mounting apparatus. The mounting apparatus is provided with a co-operating keying element.

ANOTHER EXAMPLE, U.S. Pat. No. 2,243,301 to A. J. Weinig teaches a flotation apparatus that is disposed in the lower portion of a tank and includes a rotary impeller that has vanes positioned to produce a combined pumping, slicing and striking action that causes countercurrent movement of pulp across the periphery of the impeller. A pressured gas-delivery conduit has its discharge outlet at the periphery of the impeller. This apparatus uses impeller, not propeller, and discharges pressurized gas on the periphery.

STILL ANOTHER EXAMPLE, U.S. Pat. No. 2,944,802 to C. Daman teaches an aeration apparatus of the type that has a rotary shaft that carries an impeller adjacent its lower end, and a hollow column that extends upwardly from a plane in proximity to the upper surface of the impeller and spaced from the shaft in enclosing relation thereto for delivering an aerated pulp onto the impeller. An upright tubular member is carded by and rotatable with the shaft and is in spaced relation to the impeller. The member is disposed between the shaft and the column and defines therewith a plurality of passages for dividing a descending pulp flow onto the impeller in separate streams. A restriction in each passage for accelerating pulp flow as it approaches the impeller is provided, and apparatus passage mounted for rotation with the shaft for inducing an accelerated flow through the passages and past the restriction are provided.

YET ANOTHER EXAMPLE, U.S. Pat. No. 3,046,762 to L. L. Gaubis et al. teaches a spinner assembly for a variable pitch propeller, and a hub, a shell secured to and spaced from the hub for rotational movement therewith. Both the hub and the shell define an annular air passage. An obstruction is mounted in the shell and has an opening. Air shut off apparatus cooperates with the opening for controlling the air flow through the spinner and which includes a centrifugally actuated device.

STILL YET ANOTHER EXAMPLE, U.S. Pat. No. 3,092, 185 to C. F. Alexander, Jr. teaches a bearing support member that is secured within the bore of the underwater assembly and that includes external structural members which serve as a baffle for directing the flow of the exhaust gases from the downwardly extending passage of the assembly into the rearwardly extending passage apparatus of the propeller hub.

YET STILL ANOTHER EXAMPLE, U.S. Pat. No. 3,202, 281 to D. Weston teaches a method for suspending particulate material to be treated in a first liquid to form a pulp, and for establishing and maintaining within the pulp a localized zone of concentrated reagent activity into which a reagent is fed as a finely divided mechanical dispersion in the form of a second liquid. The second liquid is immiscible with the first liquid to the extent necessary to maintain the droplets of reagent as a separate phase for the conditioning period. The pulp is progressively passed through the zone. Pressurized air is injected into the high pressure side of a propeller but not into a liquid or froth.

STILL YET ANOTHER EXAMPLE, U.S. Pat. No. 3,279, 415 to E. C. Kiekhaefer teaches a rotary hub casing which supports propeller blades and which is formed to provide an internal passage of continuously increasing section rearwardly from the housing exhaust passage. The inner annular walls of the casing are flared radially outwardly from front to rear.

YET STILL ANOTHER EXAMPLE, U.S. Pat. No. 3,342, 331 to J. R. Maxwell teaches a combined pulp conditioning and froth flotation device which has plural froth overflow edges of a length substantially greater than the perimeter of the device and a plurality of aerating injector tubes that inject air into the lower region of the pulp mass.

STILL YET ANOTHER EXAMPLE, U.S. Pat. No. 3,371, 645 to L. O. Ward teaches a directional flow exhaust regulator for internal combustion engine boats and which includes a first conduit to exhaust gases into the atmosphere, a second conduit to exhaust gases under water, a valve disposed in the first conduit, an actuator that is movable by water flow to close the valve and which is movable in the absence of water flow to open the valve, and apparatus that interconnects the valve and the actuator. The second conduit opens into an exhaust chamber which has a wall in common with a pressure chamber. The common wall is formed with a small plurality of holes. The forward wall of the pressure chamber is formed with a larger plurality of holes. The valve has an open position to allow the exhaust of gases from the first conduit and a closed position to force gases to exhaust from the second conduit.

YET STILL ANOTHER EXAMPLE, U.S. Pat. No. 3,614, 072 to James H. Brodie teaches a method and apparatus for aerating and propelling sewage in an oxidation channel that includes a support designed to extend into the channel in an inclined position. A propeller shaft is supported on the support and has a screw propeller on the lower end and a drive mechanism at the upper end above the liquid level. The carrier liquid is circulated in the channel by the propeller. Air is discharged into the liquid on the suction side of the propeller and is drawn into the propeller slipstream for intimate mixing with the liquid. Air bubbles are not cleaved, ventilation is not increased and cavitation is increased.

STILL YET ANOTHER EXAMPLE, U.S. Pat. No. 3,776, 531 to Ebner et al. teaches a propeller that disperses and entrains a fluid, particularly a gas, in a liquid. The apparatus includes a propeller shaft that is mounted for rotation and is closed at one end and has a channel therein which communicates at the other end with the fluid to be dispersed, apparatus for rotating the shaft, at least one series of diametrically aligned screw-propeller blades equidistantly spaced around the shaft that extend radially from the shaft, and a plurality of diametrically aligned aspirator tubes that are disposed proximately to the blades and equidistantly spaced around the shaft. Each of the tubes has a free end that is disposed generally radially outwardly at least as far as the outer portions of the blades. Each of the tubes has a generally longitudinally extending opening formed therethrough. Each of the openings is disposed in fluid communication with the channel. And, each of the tubes is mounted on the shaft to form an included angle between the longitudinal axis of the opening adjacent the free end thereof and the longitudinal axis of the shaft of not less than 35 degrees nor more than 75 degrees. Each of the tubes is also mounted on the shaft to form an included angle between the longitudinal axis of the opening adjacent the flee end thereof and a radially extending plane having the longitudinal axis of the shaft lying therein of not less than one-half a degree nor more than 3 degrees. A hollow shaft with propellers and tubes angled below the propellers injects gas into the high pressure side of the propeller.

YET STILL ANOTHER EXAMPLE, U.S. Pat. No. 3,788, 267 to Strong teaches the introduction of an exhaust gas or air adjacent the junction of the leading edge of each blade of a propeller and the propeller hub from the interior of the hub through which the exhaust gas or air flows.

STILL YET ANOTHER EXAMPLE, U.S. Pat. No. 3,862, 747 to Richter teaches apparatus for treating flow media wherein an additive defuser is provided in a flow passageway of an axial flow device.

YET STILL ANOTHER EXAMPLE, U.S. Pat. No. 3,947, 151 to Stillerud et al. teaches a hub marine propeller that includes an external groove that girdles the hub that is disposed between the propeller blades and the rear hub opening.

STILL YET ANOTHER EXAMPLE, U.S. Pat. No. 4,066, 722 to Pietmszewski et al. teaches a rotatable bell that includes a generally downwardly diverging shape about a central vertical axis. The outer wall surface of the bell includes a circumferentially extending jet flow surface portion with a plurality of gas flow wall openings circumferentially disposed around the base part thereof. Liquid is flowed downwardly over the jet flow surface portion of the wall from the upper part to the base part thereof to provide a flow of liquid into which gas is injected for gas-liquid contacting and mixing thereof.

YET STILL ANOTHER EXAMPLE, U.S. Pat. No. 4,240,990 to Inhofer et al. teaches an apparatus that mixes a gas and a liquid and that includes a hollow outer housing and a hollow inner tube received for rotary motion within the outer housing. A motor is attached to the outer housing adjacent a first end thereof and is drivingly coupled to a first end of the inner tube. The inner tube has a support tube which extends beyond the second end of the outer housing. Propeller blades are attached to the support tube for rotation therewith. An inlet is formed in the inner tube for admitting a gas to the hollow interior of the inner tube. The support tube has a diffusion section that extends below the propeller blades. Each propeller blade has an impelling surface with a varying rake which changes to a more positive rake from a leading end to a tail end of each propeller blade. Plates are attached to the air outlet end of the support tube. Lower portions of the plates are bent backward in the direction in which the propeller mechanism is to be rotated. No housing is provided that injects water into the low pressure side of the propeller.

STILL YET ANOTHER EXAMPLE, U.S. Pat. No. 4,276,036 to Nishida et al. teaches a marine propulsion unit that has a propeller assembly formed with exhaust gas passages through the propeller hub. An outer pipe is provided to encircle the propeller hub with a radial spacing and has a rear end that extends beyond the rear end of the hub.

YET STILL ANOTHER EXAMPLE, U.S. Pat. No. 4,431,597 to Cramer et al teaches a horizontal mixing aerator that rides on an upright beam member for submersion in a body of water such as an equalization basin, oxidation ditch, or sludge holding tank. The aerator employs a submersible mixer motor driving a propeller which is mounted on the beam member by a slidable bracket for height adjustment. The bracket is swingably mounted to the beam member for adjustment of the vertical plane angle.

STILL YET ANOTHER EXAMPLE, U.S. Pat. No. 4,511,339 to Kasschau teaches a boat propeller that controls the discharge of engine exhaust gases from the central hub of a boat motor by confining the gases to the inner most fraction of the structure (that within the shroud) and discharging it downstream of the propeller when operating the unit in either the forward or astern mode of operation.

YET STILL ANOTHER EXAMPLE, U.S. Pat. No. 4,545,771 to Iio teaches a propeller and exhaust system for an outboard motor that permits the flow of some exhaust gases in proximity to the propeller blades at low speeds.

STILL YET ANOTHER EXAMPLE, U.S. Pat. No. 4,631,032 to Nishida teaches an exhaust apparatus for a water jet propulsion boat that includes an engine exhaust passage provided inside an impeller shaft. The exhaust passage opens into the water jet at a position rearward of an impeller. The exhaust passage passes through the hollow shaft to the low pressure side of the impeller.

YET STILL ANOTHER EXAMPLE, U.S. Pat. No. 4,741,870 to Gross teaches an apparatus for the treatment of liquids, including waste liquids, by aeration. The apparatus has a propeller, a motor, and a leg that extends between the motor and propeller. The leg includes a shaft that is coupled to the motor and the shaft driving the propeller. An outer housing of the leg surrounds the shaft. Air is drawn into and through the leg on rotation of the propeller within the liquid and is discharged into the liquid adjacent the propeller. The shaft is solid while a tubular cantilever is supported at one of its ends within the outer leg housing in surrounding relation to the shaft. The tubular cantilever extends from its supported end away from the motor. Bearings support the shaft via the tubular cantilever at spaced locations along the shaft and cantilever. Air is drawn along the solid shaft into the low pressure side of the propeller.

STILL YET ANOTHER EXAMPLE, U.S. Pat. No. 4,802,872 to Stanton teaches an outer propeller hub with aerating holes that includes closure devices which seal the aeration holes during rotation of the propeller due to centrifugal forces in a predetermined speed of rotation range.

YET STILL ANOTHER EXAMPLE, U.S. Pat. No. 4,806,251 to Durda teaches a propeller type aerator and an oscillating support system. The aerator includes a tube, a propeller, and apparatus for rotating the propeller. The oscillating support system supports the aerator with the tube and propeller at an acute angle below the surface of the substance to be aerated. The support system includes a mechanism for oscillating the tube and propeller through an angle about an axis transverse to the surface of the substance to be aerated in order to disperse over an arc related to the oscillating angle, air injected through the tube into the substance. The aerator utilizes a propeller and tube to inject air into the propeller for aerating liquid.

STILL YET ANOTHER EXAMPLE, U.S. Pat. No. 4,954,295 to Durda teaches a propeller type aeration apparatus that induces a flow of fluids into a liquid that is treated by the rotation of a propeller in the liquid and which includes an outer housing that as a hollow interior, and opposite first and second ends. A drive shaft is supported for rotary motion about its axis within the hollow interior of the outer housing. A motor is connected to a first end of the drive shaft for rotating the drive shaft. A propeller is attached to a second end of the drive shaft and induces a flow of the liquid in which the propeller is disposed. At least one elongate conduit is attached to an outer surface of the outer housing. One end of the conduit is located adjacent to the propeller and in the path of the flow of the liquid caused by the propeller, and a second end of the conduit is in communication with a fluid to be injected into the liquid. Gas is injected after or at the periphery of the propeller.

FINALLY, ANOTHER EXAMPLE, U.S. Pat. No. 5,194,144 to Blough teaches an aeration device for septic tanks. Air enters the upper end of a shaft and exists adjacent a propeller. The propeller is protected from interfering with its bubble formation action by a guard bushing concentrically positioned in the air tube so that typical non- organic waste adulterants such as plastic and rubber materials, that are often found in septic tanks, are not drawn into the propeller to interfere with its action. A bushing containing holes permits air to enter the low pressure side of the propeller.

It is apparent that numerous innovations for mixing liquids and gases have been provided in the prior art that are adapted to be used. Furthermore, even though these innovations may be suitable for the specific individual purposes to which they address, they would not be suitable for the purposes of the present invention as heretofore described.

SUMMARY OF THE INVENTION

ACCORDINGLY, AN OBJECT of the present invention is to provide an apparatus for aerating and mixing of liquids and gases that avoids the disadvantages of the prior art.

ANOTHER OBJECT of the present invention is to provide an apparatus for aerating and mixing liquids and gases that is simple and inexpensive to manufacture.

STILL ANOTHER OBJECT of the present invention is to provide an apparatus for aerating and mixing liquids and gases that includes means for mixing gases, liquids, and matter suspended therein.

YET ANOTHER OBJECT of the present invention is to provide an apparatus for aerating and mixing liquids and gases that includes means for moving the gases, liquids, and matter suspended therein parallel to the axis of the shaft.

STILL YET ANOTHER OBJECT of the present invention is to provide an apparatus for aerating and mixing liquids and gases wherein the geometry of the outflow opening contained within the housing controls the outflow of the gases, liquids, and matter suspended therein.

YET STILL ANOTHER OBJECT of the present invention is to provide an apparatus for aerating and mixing liquids and gases that includes counter torque means for countering the forces generated by the motor.

STILL YET ANOTHER OBJECT of the present invention is to provide an apparatus for aerating and mixing liquids and gases that includes means for countering the forces generated by the interaction of the at least one rotating object and the gases, liquids, and matter suspended therein.

YET STILL ANOTHER OBJECT of the present invention is to provide an apparatus for aerating and mixing liquids and gases that includes feedback apparatus for redirecting the outflow of the gases, liquids, and matter suspended therein from the at least one outflow port contained in the housing to the at least one inflow port opening contained in the housing.

STILL YET ANOTHER OBJECT of the present invention is to provide an apparatus for aerating and mixing liquids and gases that includes thrust director apparatus for generating higher thrust levels.

YET STILL ANOTHER OBJECT of the present invention is to provide an apparatus for aerating and mixing liquids and gases wherein the thrust director apparatus is located within the housing and the tip of the at least one rotating object is in close proximity to the thrust director apparatus and prevents leakage of the gases, liquids, and matter suspended therein from flowing back to the low pressure side of the at least one rotating object.

STILL YET ANOTHER OBJECT of the present invention is to provide an apparatus for aerating and mixing liquids and gases that includes an ambient gas current damper that is located at the distal end of the conduit tube for negating the effects of gas currents that would interfere with and prevent the gas from entering the conduit tube.

YET STILL ANOTHER OBJECT of the present invention is to provide an apparatus for aerating and mixing liquids and gases that includes flotation apparatus for allowing the apparatus to float at or near the surface of the liquid.

STILL YET ANOTHER OBJECT of the present invention is to provide an apparatus for aerating and mixing liquids and gases that includes a hollow housing, at least one rotating object, rotating apparatus for rotating the at least one rotating object and a shaft.

YET STILL ANOTHER OBJECT of the present invention is to provide an apparatus for aerating and mixing liquids and gases that includes at least one adjustably positioned conduit tube.

STILL YET ANOTHER OBJECT of the present invention is to provide an apparatus for aerating and mixing liquids and gases wherein the hollow housing has a hollow housing upper portion and a hollow housing lower portion.

YET STILL ANOTHER OBJECT of the present invention is to provide an apparatus for aerating and mixing liquids and gases where the hollow housing upper portion has a hollow housing upper portion wall that contains at least one hollow housing upper portion wall inflow port.

STILL YET ANOTHER OBJECT of the present invention is to provide an apparatus for aerating and mixing liquids and gases wherein the hollowing housing lower portion has a hollow housing lower portion wall that contains at least one hollow housing lower portion wall outflow port.

YET STILL ANOTHER OBJECT of the present invention is to provide an apparatus for aerating and mixing liquids and gases wherein the at least one rotating object is located in the hollowing housing lower portion and has a rotating object low pressure side.

STILL YET ANOTHER OBJECT of the present invention is to provide an apparatus for aerating and mixing liquids and gases where the rotating apparatus rotates the at least one rotating object and is located in the hollow housing upper portion.

YET STILL ANOTHER OBJECT of the present invention is to provide an apparatus for aerating and mixing liquids and gases wherein the shaft connects the at least one rotating object to the rotating apparatus.

STILL YET ANOTHER OBJECT of the present invention is to provide an apparatus for aerating and mixing liquids and gases wherein the at east one adjustable positioned conduit tube passes through the at least one hollow housing upper portion inflow port and has a conduit tube first end located external the hollowing housing and a conduit tube second end located in the rotating object low pressure side that the upon rotation of the at least one rotating object a substance can be drawn from the conduit tube first end to the rotating object low pressure side.

YET STILL ANOTHER OBJECT of the present invention is to provide an apparatus for aerating and mixing liquids and gases wherein the at east one adjustable positioned conduit tube is disposed in the low pressure area proximate to the at least one hollow housing upper portion inflow port and has a conduit tube first end located external to the hollowing housing and a conduit tube second end located proximate to the at least one rotating object low pressure side upon rotation of the at least one rotating object a substance can be drawn from the conduit tube first end to the rotating object low pressure side.

STILL YET ANOTHER OBJECT of the present invention is to provide an apparatus for aerating and mixing liquids and gases wherein the substance is selected from a group consisting of a liquid, gas, and atmospheric air.

YET STILL ANOTHER OBJECT of the present invention is to provide an apparatus for aerating and mixing liquids and gases wherein the hollow housing upper portion has shape that is substantially cylindrical.

STILL YET ANOTHER OBJECT of the present invention is to provide an apparatus for aerating and mixing liquids and gases wherein the hollow housing lower portion has a shape that is selected from a group consisting of substantially cylindrical and substantially conical and tapering away from the hollow housing upper portion.

YET STILL ANOTHER OBJECT of the present invention is to provide an apparatus for aerating and mixing liquids and gases wherein the hollow housing lower portion has a shape that is selected from a group consisting of substantially cylindrical.

STILL YET ANOTHER OBJECT of the present invention is to provide an apparatus for aerating and mixing liquids and gases wherein the at least one rotating object is selected from a group consisting of a propeller and impeller.

YET STILL ANOTHER OBJECT of the present invention is to provide an apparatus for aerating and mixing liquids and gases wherein the rotating apparatus is selected from a group consisting of an electrical motor and a mechanical motor.

STILL YET ANOTHER OBJECT of the present invention is to provide an apparatus for aerating and mixing liquids and gases the further includes powering apparatus for powering the rotating apparatus.

YET STILL ANOTHER OBJECT of the present invention is to provide an apparatus for aerating and mixing liquids and gases where the powering apparatus is selected from a group consisting of AC and DC.

STILL YET ANOTHER OBJECT of the present invention is to provide an apparatus for aerating and mixing liquids and gases wherein the DC power apparatus is selected from a group consisting of energy storage apparatus.

YET STILL ANOTHER OBJECT of the present invention is to provide an apparatus for aerating and mixing liquids and gases that further includes speed regulator apparatus for regulating the speed of rotating of the at least one rotating object.

STILL YET ANOTHER OBJECT of the present invention is to provide an apparatus for aerating and mixing liquids and gases wherein the speed regulator is selected from a group including voltage control means and current control means, microprocessors, micro controllers, and digital signal processors.

YET STILL ANOTHER OBJECT of the present invention is to provide an apparatus for aerating and mixing liquids and gases that further includes a flow regulator for regulating the flow of the substance entering the rotating object low pressure side.

STILL YET ANOTHER OBJECT of the present invention is to provide an apparatus for aerating and mixing liquids and gases that further includes at least one variable geometry thrust director fins that are located in the hollow housing lower portion.

YET STILL ANOTHER OBJECT of the present invention is to provide an apparatus for aerating and mixing liquids and gases wherein each of the at least one variable geometry thrust director fins contains at least one horizontally disposed slow that receives each of the at least one rotating object.

STILL YET ANOTHER OBJECT of the present invention is to provide an apparatus for aerating and mixing liquids and gases that includes cleaving apparatus for educing the size of the substance leaving the at least one rotating object high pressure side.

YET STILL ANOTHER OBJECT of the present invention is to provide an apparatus for aerating and mixing liquids and gases wherein the cleaving apparatus is located at a position selected from a group consisting of the at least one hollow housing upper portion wall inflow port and the at least one hollow housing lower portion outflow port.

STILL YET ANOTHER OBJECT of the present invention is to provide an apparatus for aerating and mixing liquids and gases wherein the cleaving apparatus is selected from a group consisting of screen and aperture containing material.

YET STILL ANOTHER OBJECT of the present invention is to provide an apparatus for aerating and mixing liquids and gases that further includes a coaxial tube movably mounted in the hollow housing lower portion and passes through the at least one hollowing lower portion wall outflow port.

STILL YET ANOTHER OBJECT of the present invention is to provide an apparatus for aerating and mixing liquids and gases that further includes a coaxial tube movably mounted in the hollow housing lower portion and passes through the at least one hollow housing lower portion wall outflow port and interacts with the at least one hollow housing upper portion wall inflow port.

YET STILL ANOTHER OBJECT of the present invention is to provide an apparatus for aerating and mixing liquids and gases that further includes feedback apparatus for directing gas bubbles leaving the at least one hollow housing lower portion wall outflow port to enter the at least one hollow housing upper portion wall inflow port.

STILL YET ANOTHER OBJECT of the present invention is to provide an apparatus for aerating and mixing liquids and gases wherein the shaft has an outer surface that has a plurality of male screw-type threads disposed thereon and the at least one rotating object has an inner surface that has a plurality of female type-threads disposed thereon so that the at least one rotating object can be readily positioned along the shaft.

YET STILL ANOTHER OBJECT of the present invention is to provide an apparatus for aerating and mixing liquids and gases wherein the shaft has an outer surface that has a plurality of male thrusting type geometries disposed thereon and the at least one rotating object has an inner surface that has a plurality of female type thrusting geometries disposed thereon so that the at least one rotating object can be readily positioned along the shaft.

STILL YET ANOTHER OBJECT of the present invention is to provide an apparatus for aerating and mixing liquids and gases wherein the shaft has an outer surface that has male type geometries disposed thereon and the at least one rotating object has an inner surface that has female type geometries disposed thereon so that the at least one rotating object can be readily positioned along the shaft.

YET STILL ANOTHER OBJECT of the present invention is to provide an apparatus for aerating and mixing liquids and gases whereby said apparatus is operated in any position from vertical to inverted vertical and through all angles thereof.

STILL YET ANOTHER OBJECT of the present invention is to provide an apparatus for aerating and mixing liquids and gases wherein the characteristics of the at least one rotating object varies the characteristics of the at least one hollow housing upper portion wall inflow port and the at least one hollow housing lower portion wall outflow port.

YET STILL ANOTHER OBJECT of the present invention is to provide an apparatus for aerating and mixing liquids and gases wherein the characteristics of the rotating apparatus varies the characteristics of the at least one hollow housing upper portion wall inflow port and the at least one hollow housing lower portion wall outflow port.

STILL YET ANOTHER OBJECT of the present invention is to provide an apparatus for aerating and mixing liquids and gases wherein the characteristics of the at least one hollow housing upper portion wall inflow port and the at least one hollow housing lower portion wall outflow port interact to affect the separate characteristics of the at least one hollow housing upper portion wall inflow port and the at least one hollow housing lower portion wall outflow port.

The novel features which are considered characteristic of the present invention are set forth in the appended claims.

The invention itself, however, both as to its construction and its method of operation, together with additional objects and advantages thereof; will be best understood from the following description of the specific embodiments when read and understood in connection with the accompanying drawings.

LIST OF REFERENCE NUMERALS UTILIZED IN THE DRAWING

PREFERRED EMBODIMENT

10—apparatus for aerating and mixing liquids and gases of the present invention
11—liquid
12—hollow housing
12A—hollow housing upper portion
12AA—hollow housing upper portion chamber
12AB—hollow housing upper portion wall
12ABA—hollow housing upper portion wall inflow port
12AC—hollow main housing upper portion open top
12B—hollow housing lower portion
12BA—hollow housing lower portion chamber
12BB—hollow housing lower portion wall
12BBA—hollow housing lower portion wall outflow port
14—hollow conduit tube
14A—hollow conduit tube upper portion
14AA—hollow conduit tube upper portion first end
14B—hollow conduit tube lower portion
14BB—hollow conduit tube lower portion second end
14C—hollow conduit tube intermediate portion
16—motor housing
16A—motor housing upper portion
16AA—motor housing upper portion chamber
16AB—motor housing upper portion wall
16AD—motor housing upper portion bottom
16ADA—motor housing upper portion bottom orifice
16B—motor housing lower portion
16BA—motor housing lower portion first deflector fin
16BAA—motor housing lower portion first deflector fin inner surface
16BAAA—motor housing lower portion first deflector fin inner surface slot
16BAB—motor housing lower portion first deflector fin outer surface
16BB—motor housing lower portion second deflector fin
16BBA—motor housing lower portion second deflector fin inner surface
16BBAA—motor housing lower portion second deflector fin inner surface slot
16BBB—motor housing lower portion second deflector fin outer surface
16C—motor housing shaft seal
18—motor
20—power supply
22—wires
24—shaft
26—rotating object
30—flow regulator
32—screen
34—voltage regulator
36—gas bubbles
38—counter torque adaptor
40—floatation collar

ALTERNATE EMBODIMENT

110—apparatus for aerating and mixing liquids and gases of the present invention
112—hollow housing
112A—hollow housing wall
112AA—hollow housing wall inflow port
112AB—hollow housing wall outflow port
114—hollow conduit tube
116—hollow motor housing
118—motor
120—power supply
122—wires
124—shaft
126—rotating object
130—flow regulator
134—voltage regulator
140—floatation collar
142—waterproof adhesive
144—coaxial sliding sleeve

DETAILED DESCRIPTION OF THE PREFERRED EMBODIMENT

Figure 1:
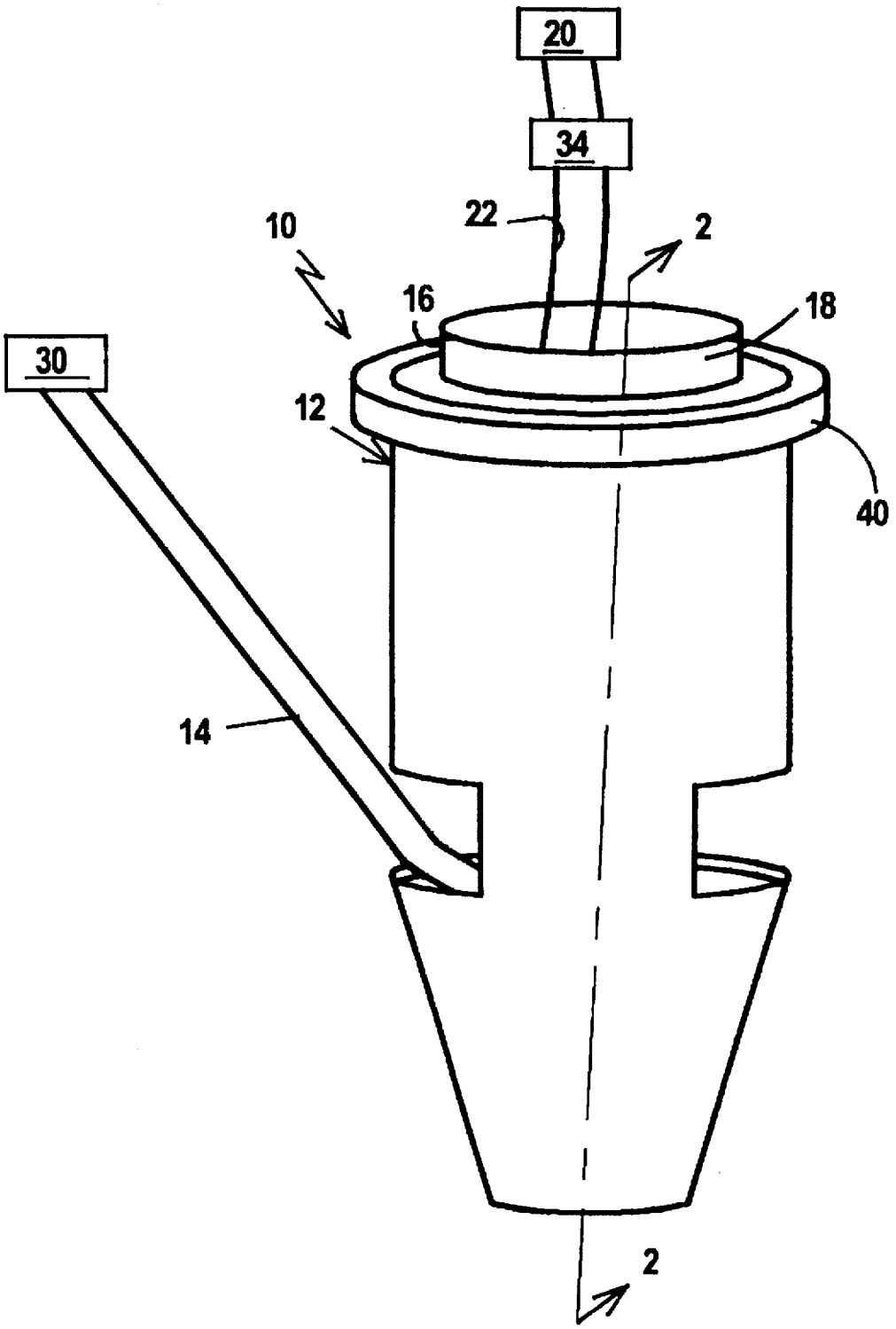
FIG. 1 is a perspective view of the apparatus for aerating and mixing liquids and gases.
Figure 2:
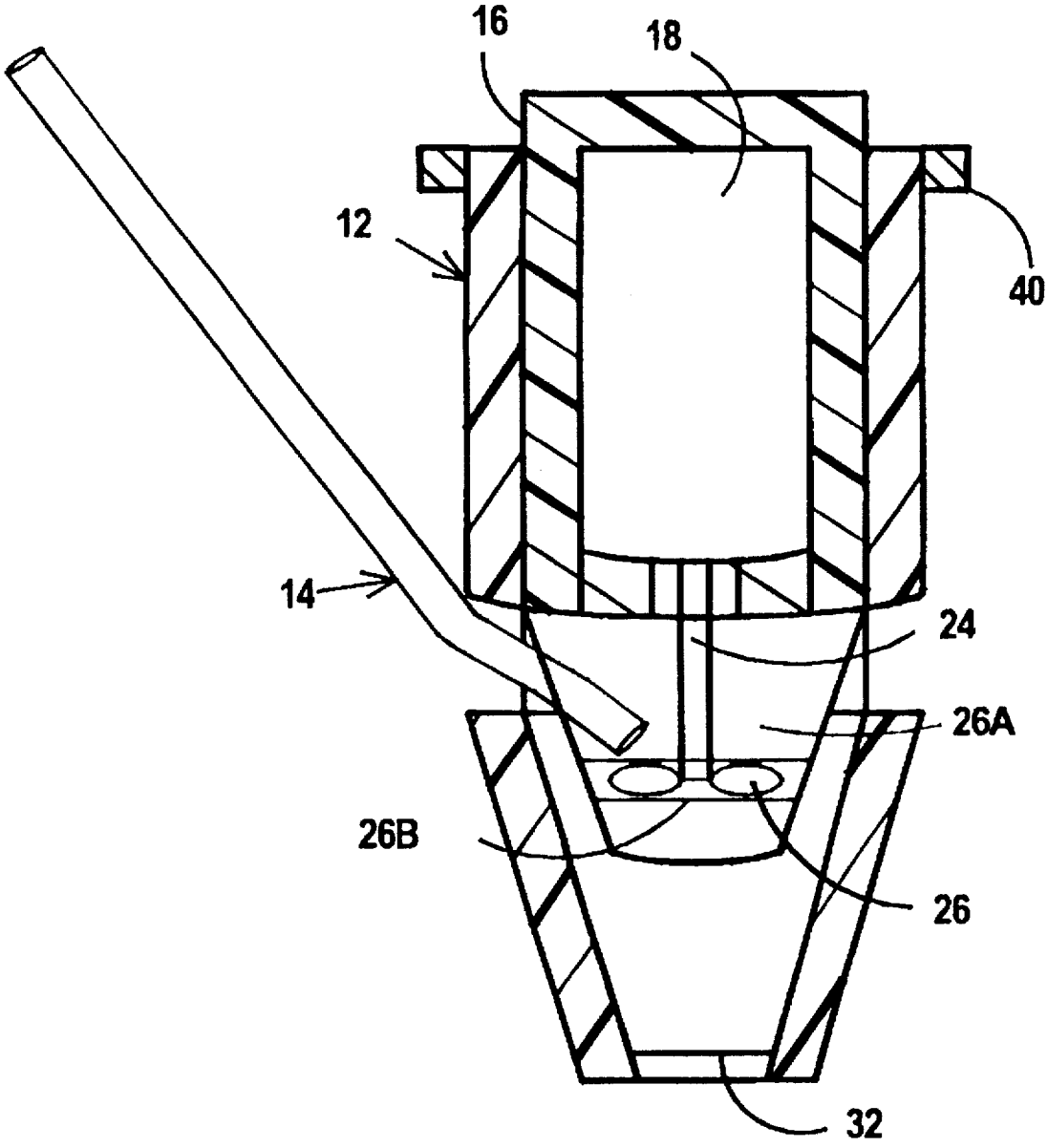
FIG. 2 is a cross sectional view taken along line 2—2 in FIG. 1.

Referring now to the figures in which like numerals indicate like parts, and particularly to FIGS. 1 and 2, the apparatus for aerating and mixing liquids and gases of the present invention is shown generally at 10, submerged in a liquid II, and which includes a hollow main housing 12, at least one conduit tube 14 passing into the hollow main housing 12, but is not limited to that, a motor housing 16 received by the hollow main housing 12, a motor 18 received by the motor housing 16, a power supply 20 for powering the motor 18, wires 22 emanating from the power supply 20 and passing into the motor housing 16, a shaft 24 that emanates from and is revolved by the motor 18 and passes through the motor housing 16, and at least one rotating object 26 that has a rotating object low pressure side 26A, but not limited to that, and a rotating object high pressure side 26B and which is attached to the shaft 24.

It is to be mentioned that the present invention shown generally at 10 of FIGS. 1 and 2 may be operated in a various orientations from vertical through 180 degrees to inverted and horizontal through 360 degrees and combinations of these.

It is to be further mentioned that the motor housing 16 can be a sealed unit that includes the motor 18, the power supply 20 when the power supply 20 is direct current batteries, and the wires 22 that connect the power supply 20 to the motor 18. Also, the power supply 20 can be an alternating current supply or a direct current supply, such as 1.5 volt direct current alkaline or rechargeable batteries, but is not limited to that. However, the power supply 20 should be direct current when the apparatus for aerating and mixing liquids and gases 10 is utilized for aeration of aquariums since it will not electrocute an individual or the aquatic life should the motor 18 short to liquid 11.

The configuration of the hollow main housing 12 can best be seen in FIGS. 3 and 4, and as such, will be discussed with reference hereto.

The hollow main housing 12 includes a hollow main housing upper portion 12A and a hollow main housing lower portion 12B. The hollow main housing upper portion 12A of the hollow main housing 12 is substantially cylindrical in shape, but is not limited to that, while the hollow main housing lower portion 12B is substantially conical in shape tapering away from the hollow main housing upper portion 12A of the hollow main housing 12, but is not limited to that.

It is to be mentioned that the hollow main housing upper portion 12A can be a portion independent of hollow main lower portion 12B and hollow main lower portion 12B can be a portion independent of hollow main upper portion 12A and hollow main housing upper portion 12A and hollow main lower portion 12B can be joined together to form hollow main housing 12, but is not limited to that.

The hollow main housing upper portion 12A of the hollow main housing 12 contains a hollow main housing upper portion chamber 12AA which is defined by a hollow main housing upper portion wall 12AB. At least one hollow main housing upper portion inflow port 12ABA is contained in the hollow main housing wall 12AB of the hollow main housing upper portion 12A of the hollow main housing 12.

It is to be mentioned that at least one hollow portion inflow port 12ABA can be contained in an independent main lower portion comprised of the inflow port 12ABA and the hollow main lower portion 12B, but is not limited to that.

The hollow main housing lower portion 12B of the hollow main housing 12 contains a hollow main housing lower portion chamber 12BA which is defied by a hollow main housing lower portion wall 12BB. At least one hollow main housing lower portion wall outflow port 12BBA is contained in the hollow main housing lower portion wall 12BB of the hollow main housing lower portion 12B of the hollow main housing 12.

The main housing 12 is a multi-function enclosure and is configured so that the geometry of the at least one hollow main housing upper portion wall inflow port 12ABA that is contained in the hollow main housing upper portion wall 12AB of the hollow main housing upper portion 12A of the hollow main housing 12 can be varied so that the flow therethrough can be adjusted. The geometry of the at least one hollow main housing lower portion wall outflow port 12BBA that is contained in the hollow main housing lower portion 12B of the hollow main housing 12 can also be varied so that the flow therethrough can be adjusted.

The design of the at least one hollow main housing upper portion wall inflow port 12ABA that is contained in the hollow main housing upper portion wall 12AB of the hollow main housing upper portion 12A of the hollow main housing 12, and the design of the at least one hollow main housing lower wall outflow port 12BBA that is contained in the hollow main housing lower portion 12B of the hollow main housing 12 is based on the principle that as the speed of a liquid or gas increases the pressure decreases, that is, the speed of the liquid or gas is inversely proportional to the pressure.

Figure 5:
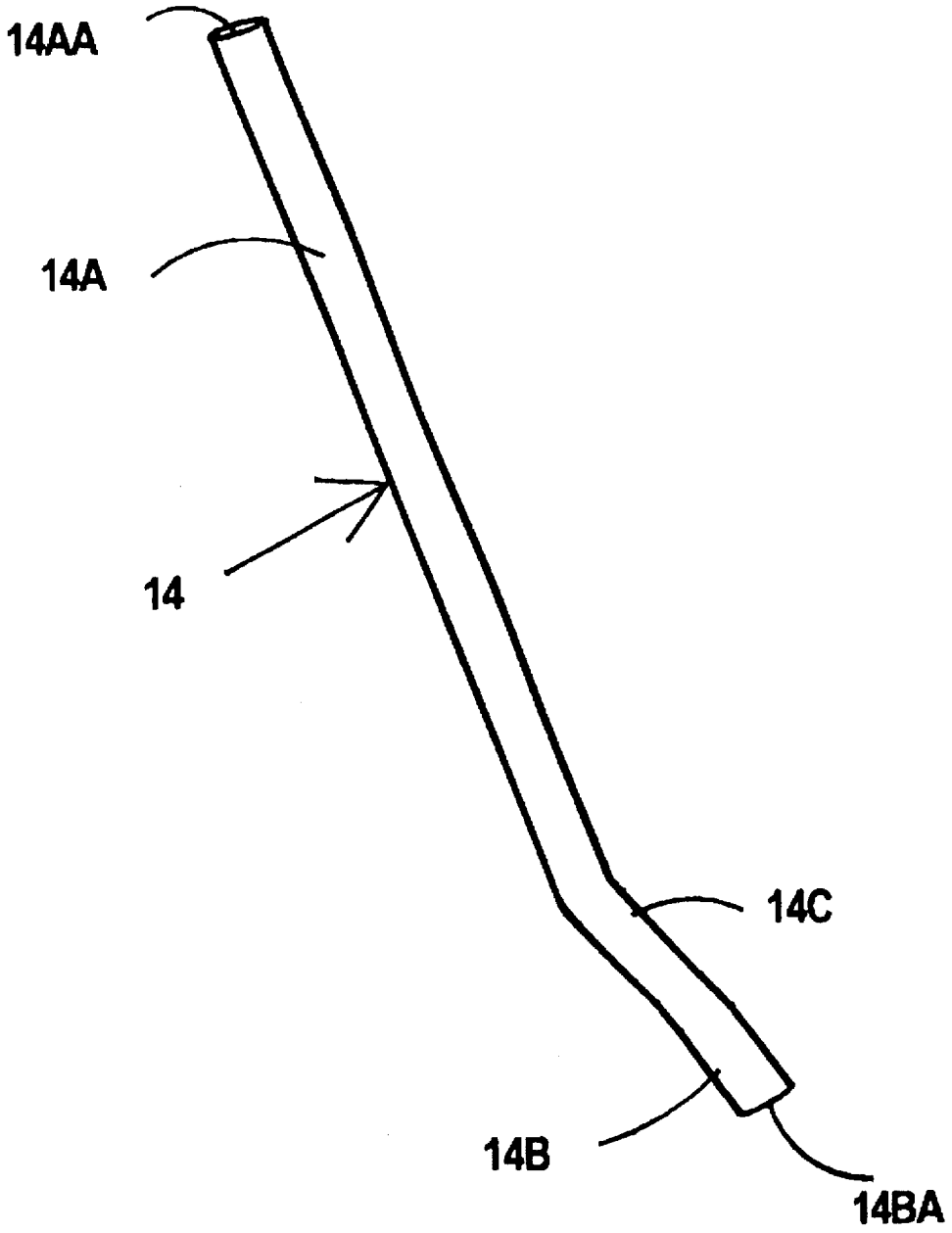
FIG. 5 is a perspective view of the hollow conduit tube.

The configuration of the at least one hollow conduit tube 14 can best be seen in FIG. 5, and as such, will be discussed with reference thereto.

The at least one hollow conduit tube 14 has a hollow conduit upper portion 14A and a hollow conduit tube lower portion 14B, and is substantially cylindrical in shape, but is not limited to that. The hollow conduit tube upper portion 14A of the at least one hollow conduit tube 14 and the hollow conduit tube lower portion 14B of the at least one hollow conduit tube 14 do not necessarily have to be collinear but are connected to each other by a hollow conduit tube intermediate portion 14C. The hollow conduit tube upper portion 14A of the at least one hollow conduit tube 14 has a hollow conduit tube upper portion open distal end 14AA and the hollow conduit tube lower portion 14B of the at least one hollow conduit tube 14 has a hollow conduit tube lower portion open proximal end 14BA.

The hollow conduit tube upper portion open distal end 14AA, of the hollow conduit tube upper portion 14A of the at least one on conduit tube 14, and the hollow conduit tube lower portion open proximal end 14BA of the hollow conduit tube lower potion 14B of the at least one hollow conduit tube 14 are of such geometry so as to maximize the effects of and the amount of low pressure generated by the at least one rotating object 26 in the rotating object low pressure side 26A of the at least one rotating object 26.

It is to be mentioned that when the power supply 20 is of a low direct current voltage such as 0.8 volts, the speed of the at least one rotating object 26 is reduced and, therefore, the conduit tube lower portion proximal end 14BA of the conduit tube lower portion 14B of the at least one conduit tube 14 must be located within a close proximity such as 0.005 inches of the horizontal plane of the at least one rotating object 26 in order for the ventilation of the at least one rotating object 26 to be initiated.

The at least one hollow conduit tube 14 is disposed in proximity to the at least one hollow main housing upper potion wall inflow port 12ABA that is contained in the hollow main housing upper potion wall 12AB of the hollow main upper portion 12A of the hollow main housing 12.

It is to be mentioned that when the speed of the at least one rotating object 26 increases there is also a decrease in the low pressure side 26A which progresses outward through the at least one hollow main housing upper portion wall inflow port 12ABA that is contained in the hollow main housing upper portion wall 12AB of the hollow main upper portion 12A of the hollow main housing 12 such that the at least one hollow conduit tube lower portion open proximal end 14BA of the at least one conduit tube 14 can be located proximal and exterior to the hollow main housing upper portion wall inflow port 12ABA of the hollow main housing upper portion wall 12AB of the hollow main upper portion 12A of the hollow main housing 12.

The position of the at least one conduit tube 14 relative to the at least one hollow main housing upper portion wall inflow port 12ABA that is contained in the hollow main housing upper potion wall 12AB of the hollow main housing upper portion 12A of the hollow main housing 12 can be adjusted in both the horizontal direction and in the vertical direction and can also be angularly rotated so that the conduit tube lower potion proximal end 14BA of the conduit tube lower potion 14B of the at least one conduit tube 14 can be located at an optimum proximate position to the rotating object low pressure side 26A of the at least one rotating object 26.

The conduit tube upper portion distal end 14AA of the conduit tube upper portion 14A of the at least one conduit tube 14 is exposed to the gases and/or liquids at ambient or other pressures and therefore provides communication of these gases and/or liquids with the rotating object low pressure side 26A of the at least one rotating object 26. However the conduit tube upper portion distal end 14AA of the conduit tube upper portion 14A of the at least one conduit tube 14 may be coupled to gases or liquids and combinations thereof feeds. A flow regulator 30 (see FIG. 1), may be positioned at the conduit tube upper potion distal end 14AA of the conduit tube upper portion 14A of the at least one conduit tube 14 to adjust the flow of the liquids and gases entering the conduit tube upper portion distal end 14AA of the conduit tube upper portion 14A of the at least one conduit tube 14.

It is to be mentioned that the flow regulation 30 may also be composed of such structure to minimize adverse affects of ambient gas currents that would otherwise adversely affect the process of ventilation.

Figure 6:
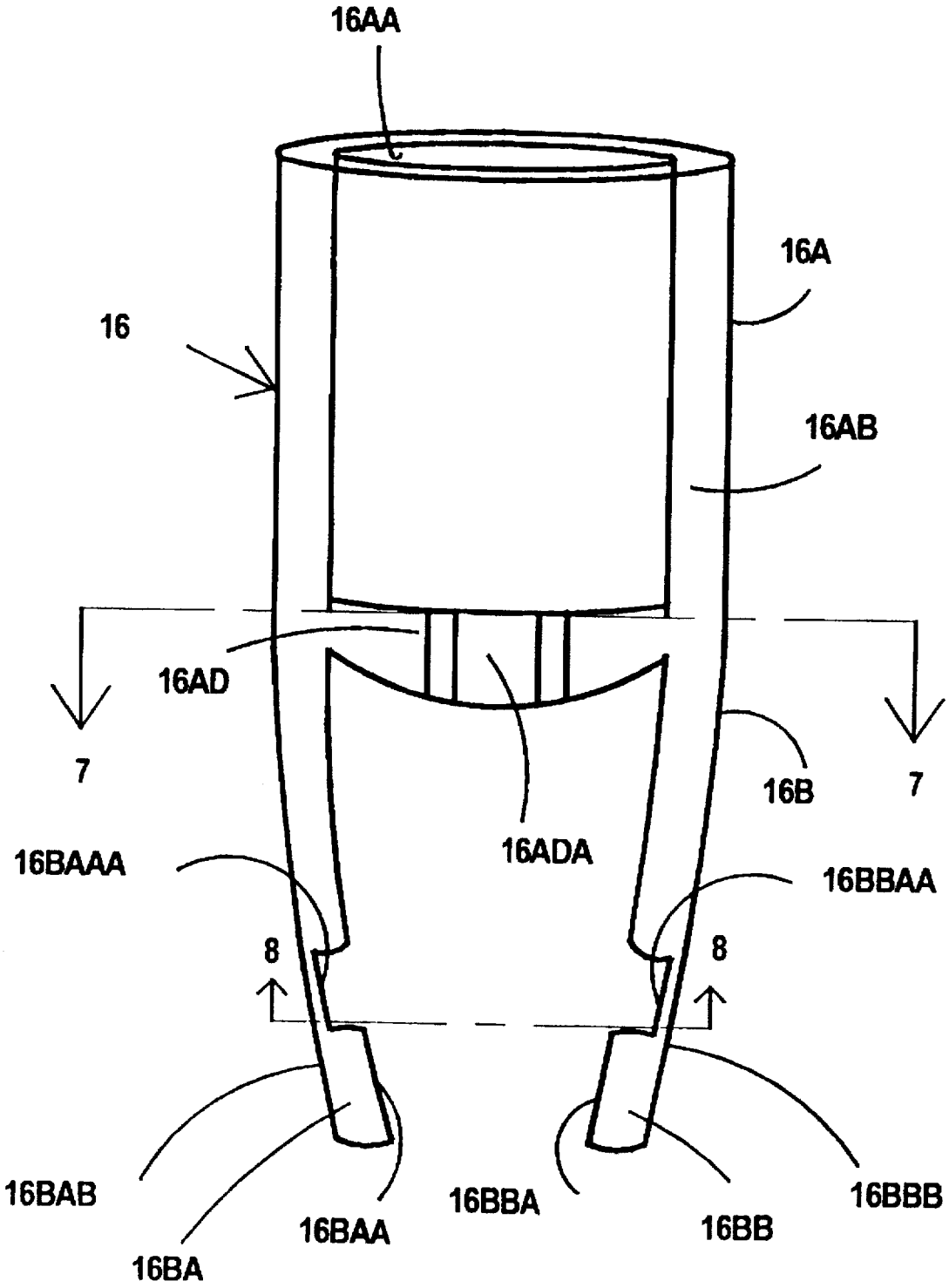
FIG. 6 is a perspective view of the motor housing.
Figure 7:
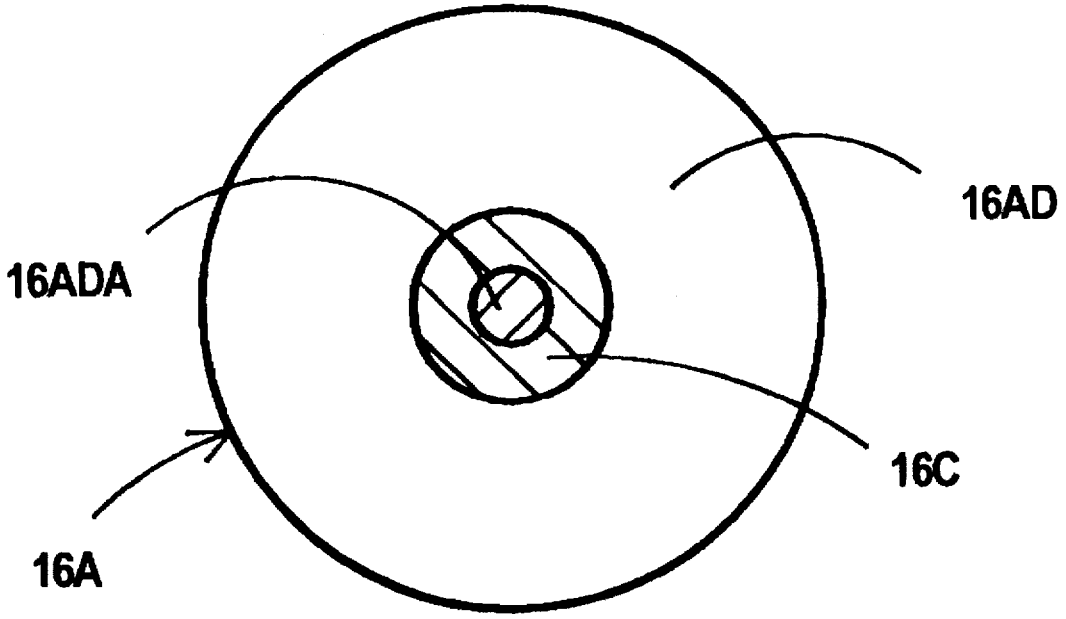
FIG. 7 is a cross sectional view taken along line 7—7 in FIG. 6.
Figure 8:
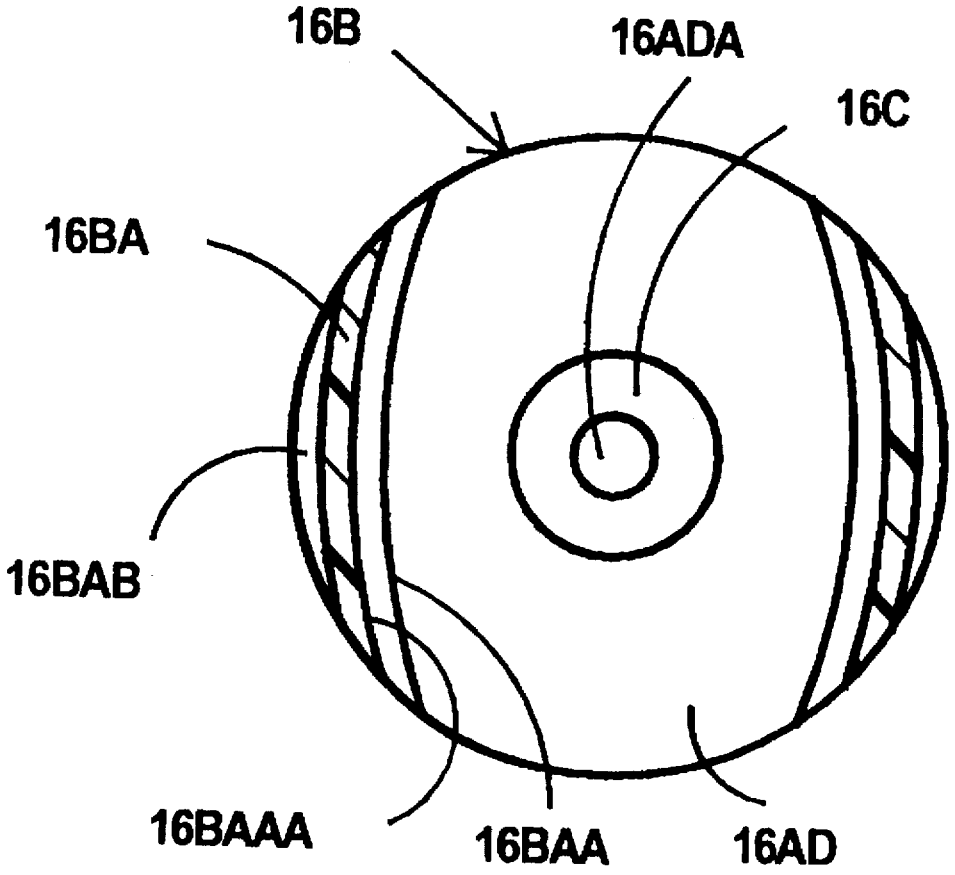
FIG. 8 is a cross sectional view taken along line 8—8 in FIG. 6.

The configuration of the motor housing 16 can best be seen in FIGS. 6 through 8, and as such, will be discussed with reference thereto.

The motor housing 16 may be comprised of various materials and includes a motor housing hollow upper portion 16A and a motor housing lower portion 16B. The motor housing hollow upper portion 16A of the motor housing 16 contains a motor housing upper portion chamber 16AA, which is defined by a motor housing hollow upper portion wall 16AB.

The motor housing hollow upper portion 16A of the motor housing 16 has a motor housing hollow upper closed bottom 16AD which is substantially hemispherical in shape, but is not limited to that. The hemispherical geometry shapes the flow towards the at least one rotating object 26 and interacts with the at least one hollow main housing upper portion wall inflow port 12ABA that is contained in the hollow main housing upper portion wall 12AB of the hollow main housing upper portion 12A of the hollow main housing 12.

The motor housing hollow upper portion closed bottom 16AD of the motor housing hollow upper portion 16A of the motor housing 16 contains a motor housing hollow upper portion closed bottom orifice 16ADA through which is disposed a motor housing seal 16C. The motor housing hollow upper portion closed bottom orifice seal 16C of the motor housing 16 provides a waterproof seal and lubrication for the shaft 24 while preventing foreign matter from entering the hollow main housing upper portion 12A of the hollow main housing 12 and causing degradation therein.

The shape of the motor housing hollow upper portion closed bottom 16AD of the motor housing hollow upper portion 16A of the motor housing 16 is critical when the power supply 20 is of a low voltage, for example, 0.8 volts direct current. This shape of the motor housing hollow upper portion closed bottom 16AD of the motor housing upper portion 16A of the motor housing 16 must be configured so as to affect the lowest possible pressure of the rotating objection low pressure side 26A of the at least one rotating object 26 by reducing impedances associated with non-laminar fluid flow.

It is to be mentioned that the shape of the motor housing hollow upper portion closed bottom 16AD of the motor housing upper portion 16A of the motor housing 16 interacts with the at least one hollow main housing upper portion wall inflow port 12ABA of the hollow main housing upper portion wall 12AB of the hollow main housing upper portion 12A of the hollow main housing 12 and the at least one rotating object 26 of the main hollow housing 12 such that the geometry of the hollow upper closed bottom 16AD can be varied by varying those interacting parts.

When the shape of the motor housing hollow upper portion closed bottom 16AD of the motor housing hollow upper portion 16A of the motor housing 16 is flat, ventilation will occur at approximately 1.0 volts direct current, however, when the shape of the motor housing upper portion closed bottom 16AD of the motor housing hollow upper portion 16A of the motor housing 16 is curved to form a more rounded geometry such as hemispherical, but not limited to that, ventilation will occur at only 0.8 volts direct current. This represents a ventilation efficiency increase of 25 percent due to the use of a motor housing hollow upper portion closed bottom 16AD of the motor housing hollow upper portion 16A of the motor housing 16 that is hemispherically shaped, but is not limited to that.

When the shape of the motor housing hollow upper portion closed bottom 16AD of the motor housing upper portion 16A of the motor housing 16 is flat, but not limited to that, ventilation can be induced to occur at less than 1.0 volt direct current by independently or in combination adjusting the parameters of the at least one rotating means 26 communicating with shaft 24 communicating with motor 18 of motor housing upper portion 16A of the motor housing hollow upper portion 16, the motor housing upper portion closed bottom 16AD of the motor housing hollow upper portion 16A of the motor housing 16, the at least one hollow main housing upper portion wall inflow port 12ABA of the hollow main housing upper portion wall 12AB of the hollow main housing upper portion 12A of the hollow main housing 12 and the at least one rotating object 16 of the main hollow housing 12.

The motor housing lower portion 16B of the motor housing 16 is defined by a motor housing at least one lower portion first thrust director fin 16BA and a motor housing lower portion at least one second thrust director fin 16BB and emanate from the motor housing hollow upper portion 16A of the motor housing 16 and are spatially disposed within the motor housing lower portion 16B of the motor housing 16, but is not limited to that.

It is to be mentioned that at least one first thrust director fin 16BA, and at least one second thrust director fin 16BB and respective component parts, (16BAB, 16BAA, 16BAAA, 16BBA, 16BBB, 16BBAA), but is not limited to that, may also be constructed as part of and emanate from the motor housing lower portion 16B of the motor housing 16, but is not limited to that.

The motor housing lower portion at least one first thrust director fin 16BA of the motor housing lower portion 16B of the motor housing 16 has a motor housing lower portion first thrust director fin inner surface 16BAA and a motor housing lower portion first thrust director fin outer surface 16BAB.

The motor housing lower portion at least one second thrust director fin 16BB of the motor housing lower portion 16B of the motor housing 16 has a motor housing lower portion at least one second thrust director fin inner surface 16BBA and a motor housing lower portion at least one second thrust director fin outer surface 16BBB.

The motor housing lower portion at least one first thrust director fin outer surface 16BAB of the motor housing lower portion of the at least one first thrust director fin 16BA of the motor housing lower portion 16B of the motor housing 16 and the motor housing lower portion at least one second thrust director fin outer surface 16BBB of the of the motor housing lower portion at one second thrust director fin 16BB of the motor housing lower portion 16B of the motor housing 16 both are in contact with the hollow main housing lower portion wall 12BB of the hollow main housing lower portion 12B of the hollow main housing 12, but are not limited to that.

Figure 13:
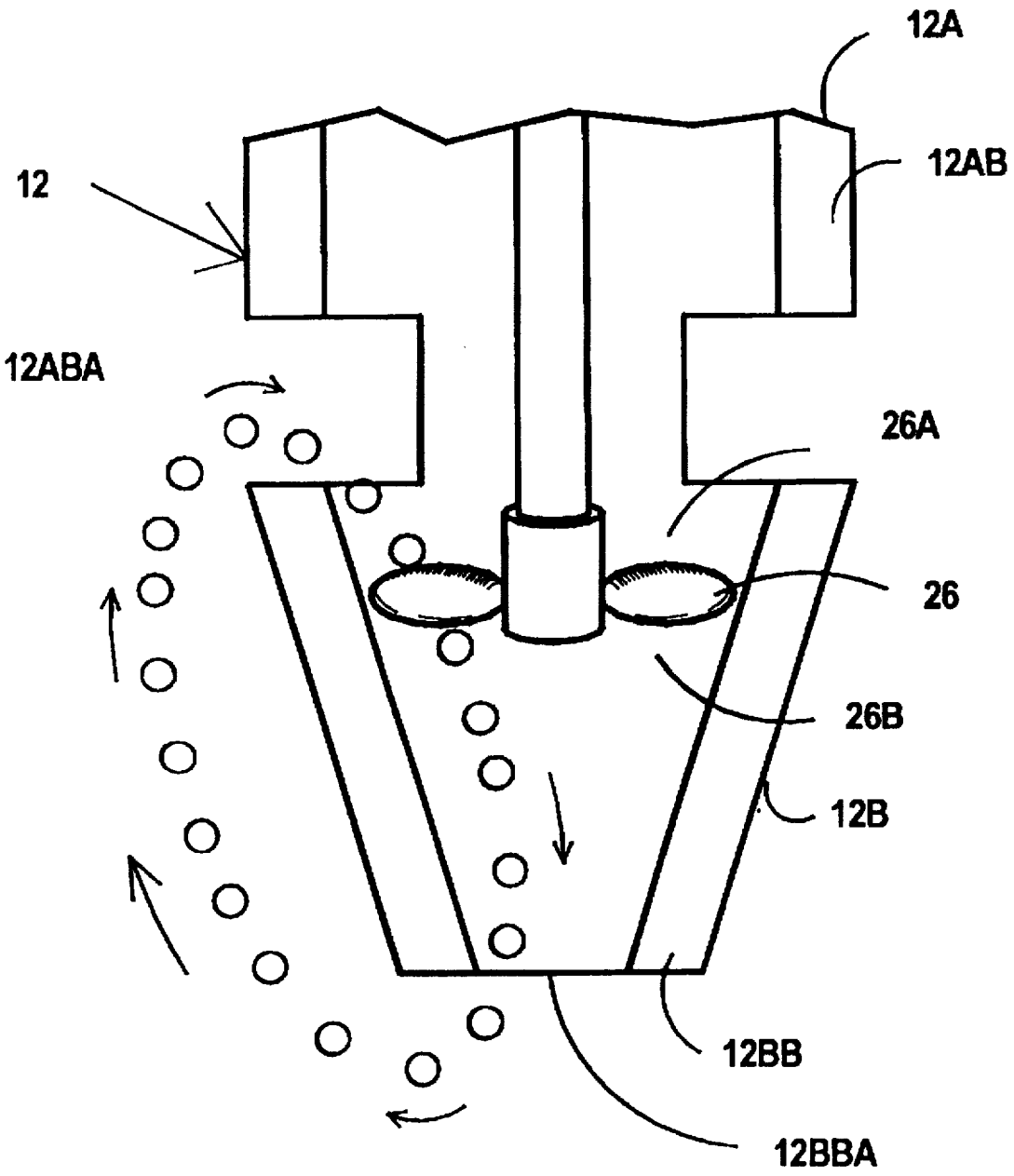
FIG. 13 is a fragmented view showing the feedback effect.

The motor housing lower portion first thrust director fin inner surface 16BAA of the motor housing lower portion at least one first thrust director fin 16BA of the motor housing lower portion 16B of the motor housing 16 contains at least one motor housing lower portion first thrust director fin inner surface slot 16BAAA which is generally horizontally disposed and conforms to the horizontal rotational plane of the at least one rotating object 26 (see FIG. 13) of the hollow main housing lower portion 12B (see FIG. 13) of the hollow main housing 12 (see FIG. 13).

It is to be mentioned that the thrust director fins 16BA and 16BB and associated geometries of the motor housing lower portion 16B of the motor housing 16 may be combined to form a circular configuration of thrust director geometries encompassing 360 degrees of motor housing lower portion 16B of the motor housing 16, but is not limited to that.

It is to be further mentioned that the thrust director fin inner surfaces 16BAAA may be configured to form a circular configuration of inner surface geometries encompassing 360 degrees of the motor housing lower portion 16B of the motor housing 16, but is not limited to that.

The motor housing 16 passes through the hollow main housing upper portion open top 12AC of the hollow main housing upper portion 12A of the hollow main housing 12 and is received by the hollow main housing upper portion chamber 12AA of the hollow main housing upper portion 12A of the hollow main housing 12.

Figure 9:
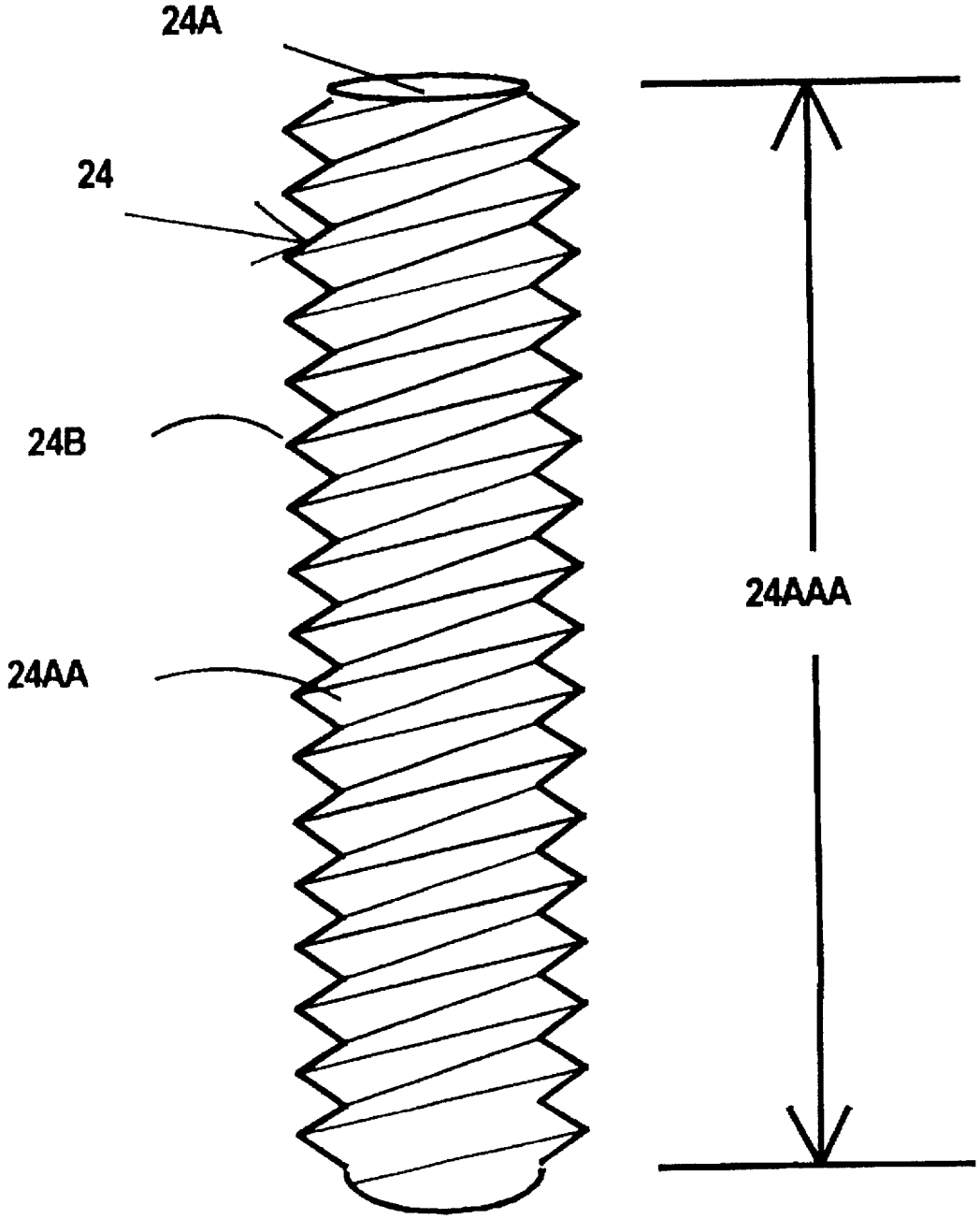
FIG. 9 is a perspective view of the shaft.

The configuration of the shaft 24 can best be seen in FIG. 9, and as such, will be discussed with reference thereto.

The shaft 24 includes a shaft body 24A that is generally cylindrical in shape, but is not limited to that, and has a shaft body outer surface 24AA with a shaft body outer surface length 24AAA. A plurality of male screw-type threads 24B are disposed along the entire shaft body outer surface length 24AAA of the shaft body outer surface 24AA of the shaft body 24A of the shall 24.

The shaft 24 receives the at least one rotating object 26 while the plurality of male screw type threads 24B of the shaft 24 reduce cavitation by channeling liquid to the rotating object low pressure side 26A of the at least one rotating object 26 and allow for the variable positioning of the at least one rotating object 26 thereon.

It is to be mentioned that the shaft 24 may be of a general configuration to accept the at least one rotating object 26 and allow for the variable positioning of the at least one rotating object 26 of hollow main housing lower portion 12B of the hollow main housing 12.

It is to be further mentioned that the plurality of screw-type threads 24B of shaft 24 may also be configured as sections of a rotating object thereby affecting the downward thrust of liquids into the at least one rotating object 26 and affecting the pressure in the low pressure side 26A of the hollow main housing lower portion 12B of the hollow main housing 12.

Figure 10:
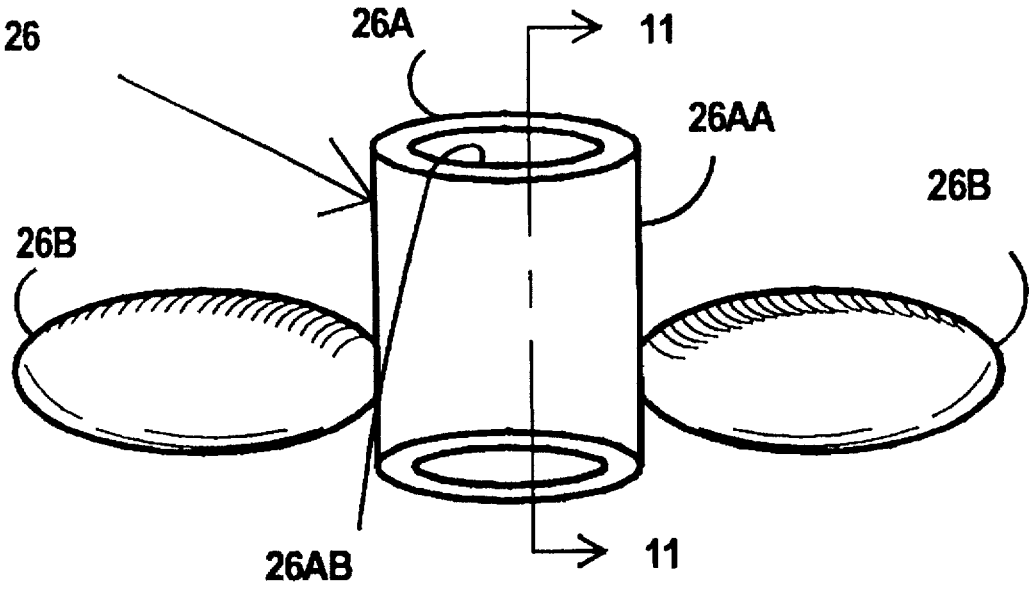
FIG. 10 is a perspective view of the rotating object.
Figure 11:
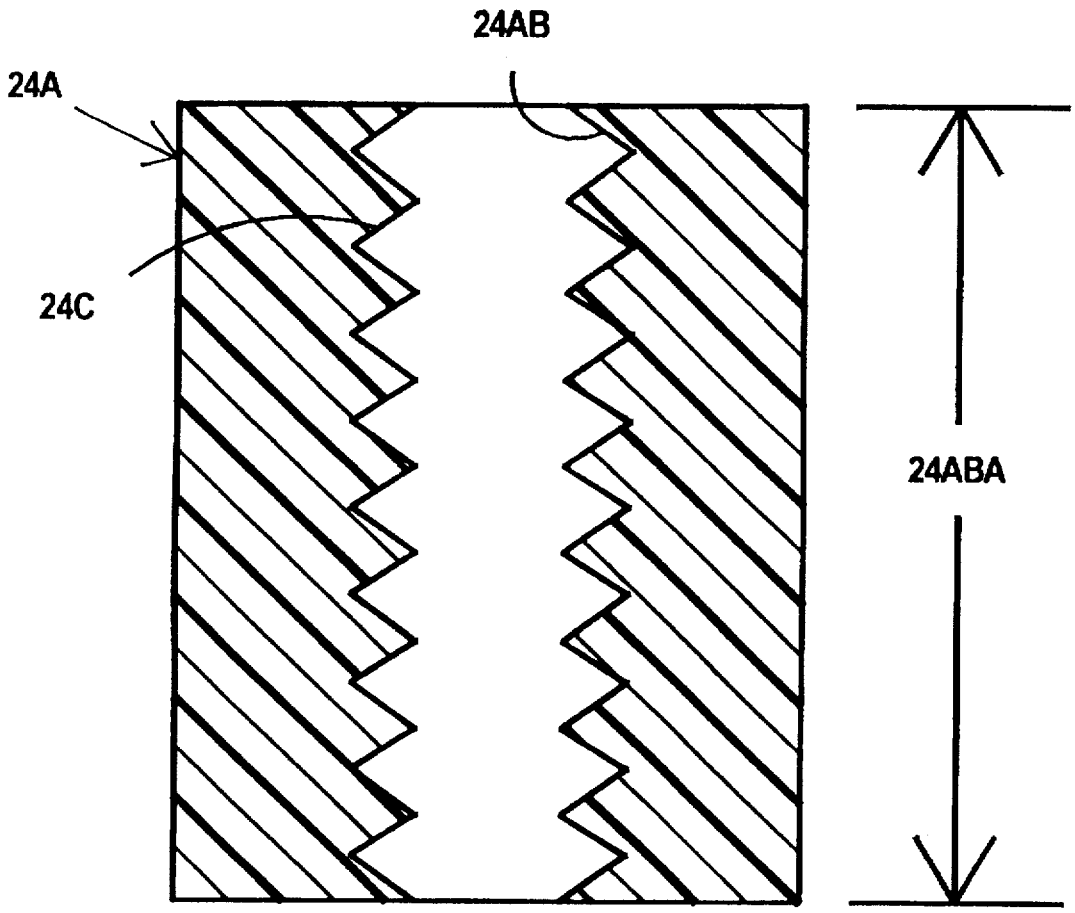
FIG. 11 is a cross sectional view taken along line 11—11 in FIG. 10.

The configuration of the at least one rotating object 26 can best be seen in FIGS. 10 and 11, and as such, will be discussed with reference thereto.

The at least one rotating object 26 may be a propeller or an impeller or any combination thereof but is not limited to them, and includes a rotating object hub 26A and an at least one rotating object blade 26B. The rotating object hub 26A of the at least one rotating object 26 has a rotating object hub outer surface 26AA onto which the rotating object blade 26B of the at least one rotating object 26 is disposed. The rotating object hub 26A of the at least one rotating object 26 has a rotating object hub inner surface 26AB with a rotating object hub inner surface length 26ABA. A plurality of female screw type threads 26C are disposed along the entire rotating object hub inner surface length 26ABA of the rotating object hub inner surface 26AB of the rotating object hub 26A of the at least one rotating object 26.

It is to be mentioned that the plurality of female screw type threads 26C which are disposed along the entire rotating object hub inner surface length 26ABA of the rotating object hub inner surface 26AB of the rotating object hub 26A of the at least one rotating object 26 are not limited to female screw type threads but can also be of a geometry to couple with a male type shaft comprised of other geometries that would act as a male type thread but also increase the thrust of liquid to the at least one rotating object 26.

It is further mentioned that shaft 24 may be an integral part of motor 18 and/or an extension coupled thereto, but not limited to that.

Figure 12:
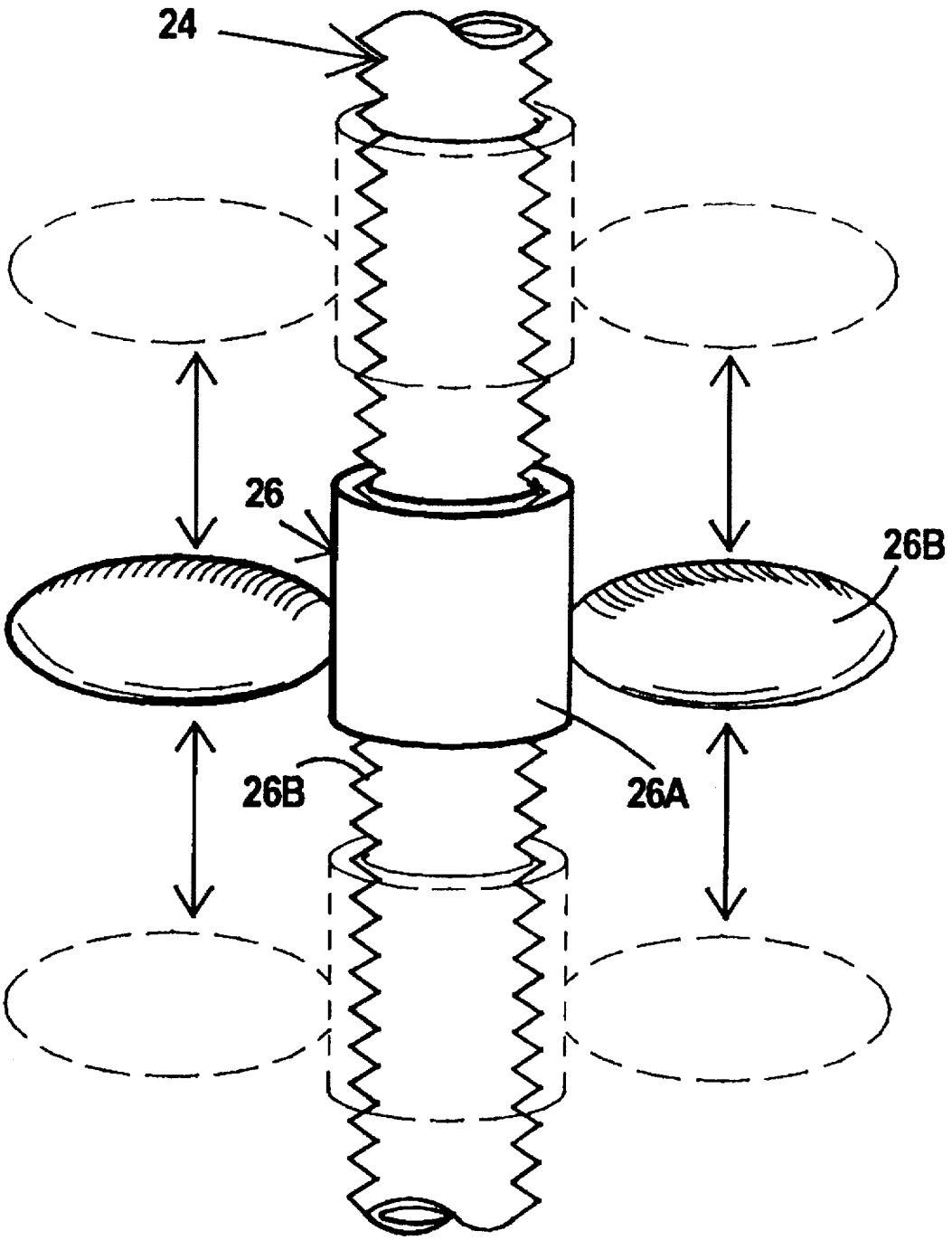
FIG. 12 is a perspective view of the rotating object being adjustably mounted on the shaft.

The variable positioning of the at least one rotating object 26 on the shaft 24 can best be seen in FIG. 12, and as such, will be discussed with reference thereto.

The at least one rotating object 26 is placed on the shaft 24 so that the plurality of male type screw threads 24B of the shaft 24 mate with the plurality of female screw type threads 26C of the rotating object 26. By mining the at least one rotating object 26 relative to the shaft 24, the at least one rotating object 26 can be moved up and down the shaft 24 and therefore be variably positioned on the shaft 24.

It is to be mentioned that the shaft 24 may be of a general geometry and the at least one rotating object hub inner surface 26AB may be of a general geometry to mate with shaft 24 and such variable positioning can be accomplished by frictionally interfacing of the at least one rotating object inner hub surface 26AB with shaft 24.

With the adjustability of the at least one rotating object 26, the position of the at least one rotating object 26 relative to the hollow main housing upper portion wall inflow port 12ABA that is contained in the hollow main housing upper portion wall 12AB of the hollow main housing upper portion 12A of the hollow main housing 12 and the conduit tube lower portion proximal end 14B of the at least one conduit tube 14, can be adjusted.

When more than one rotating object 26 is used, each rotating object 26 can be of a different characteristics with respect to each other and can be offset to each other up to 180 degrees and can be displaced a variable distance between each other. Due to the adjustability of the at least one rotating object 26, the distance between each rotating object 26 can also be adjusted. This spacing adjustment allows for providing specific configurations necessary to meet the requirements of the gases and liquids involved. The use of more than one rotating object 26, provides controllability of ventilation, induction of gases and liquids, and thrust and therefore virtually eliminates cavitation, over ventilation, and loss of thrust.

At constant viscosity, the rate of ascent of a gas bubble and the rate of absorption of a gas in a liquid is inversely proportional to the size of the gas bubble. Therefore, to minimize the rate of ascent of a gas bubble and maximize the rate absorption of a gas in a liquid, the size of the gas bubble must be minimized. This can be accomplished by place a cleaving structure, such as a screen 32 (see FIG. 2), but is not limited to that, over the at least one hollow main housing lower portion wall outflow port 12BBA that is contained in the hollow main housing lower portion wall 12BB of the hollow main housing lower portion 12B of the hollow main housing 12.

Filters of various types can be fitted to the at least one hollow main housing upper portion wall inflow port 12ABA that is contained in the hollow main housing upper portion wall 12AB of the hollow main housing upper portion 12A of the hollow main housing 12 and to the at least one hollow main housing lower portion wall outflow port 12BBA that is contained in the hollow main housing lower portion wall 12BB of the hollow main housing lower portion 12B of the hollow main housing 12. The filters remove any matter which would impede the flow of the fluid through the at least one hollow main housing upper portion wall inflow port 11ABA that is contained in the hollow main housing upper portion wall 12AB of the hollow main housing upper portion 12A of the hollow main housing 12 and through the at least one hollow main housing lower portion wall outflow port 12BBA that is contained in the hollow main lower portion wall 12BB of the hollow main housing lower portion 12B of the hollow main housing 12. The screen 32 can readily be adapted to function as such filters, but is not limited to them.

Other ways of varying the size of the gas bubbles include varying the volume of the fluid introduced into the liquid 11, which can be accomplished by the use of the flow regulator 30. Also, varying the speed of rotation of the shaft 24 can be accomplished by the use of a potentiometer 34 (see FIG. 1), but not limited to that, placed in the circuit connecting to the power supply 20 to the motor 18. Another way of varying the size of the gas bubbles is by use of feedback.

The feedback operation can best be seen in FIG. 13, and as such, will be discussed with reference thereto.

Gas bubbles 36 of a varying sizes exit the rotating object high pressure side 26B of the at least one rotating object 26 and pass through the at least one hollow main housing lower portion wall outflow port 12BBA that is contained in the hollow main housing lower portion wall 12BB of the hollow main housing lower portion 12B of the hollow main housing 12. The gas bubbles 36 are then drawn by the action of the rotating object low pressure side 26A of the at least one rotating object 26, through the hollow main housing upper portion wall inflow port 12ABA that is contained in the hollow main housing upper portion wall 12AB of the hollow main housing upper portion 12A of the hollow main housing 12 and back through the at least one rotating object 26 where the gas bubbles 36 become further cleaved and reduced in size.

Figure 3:
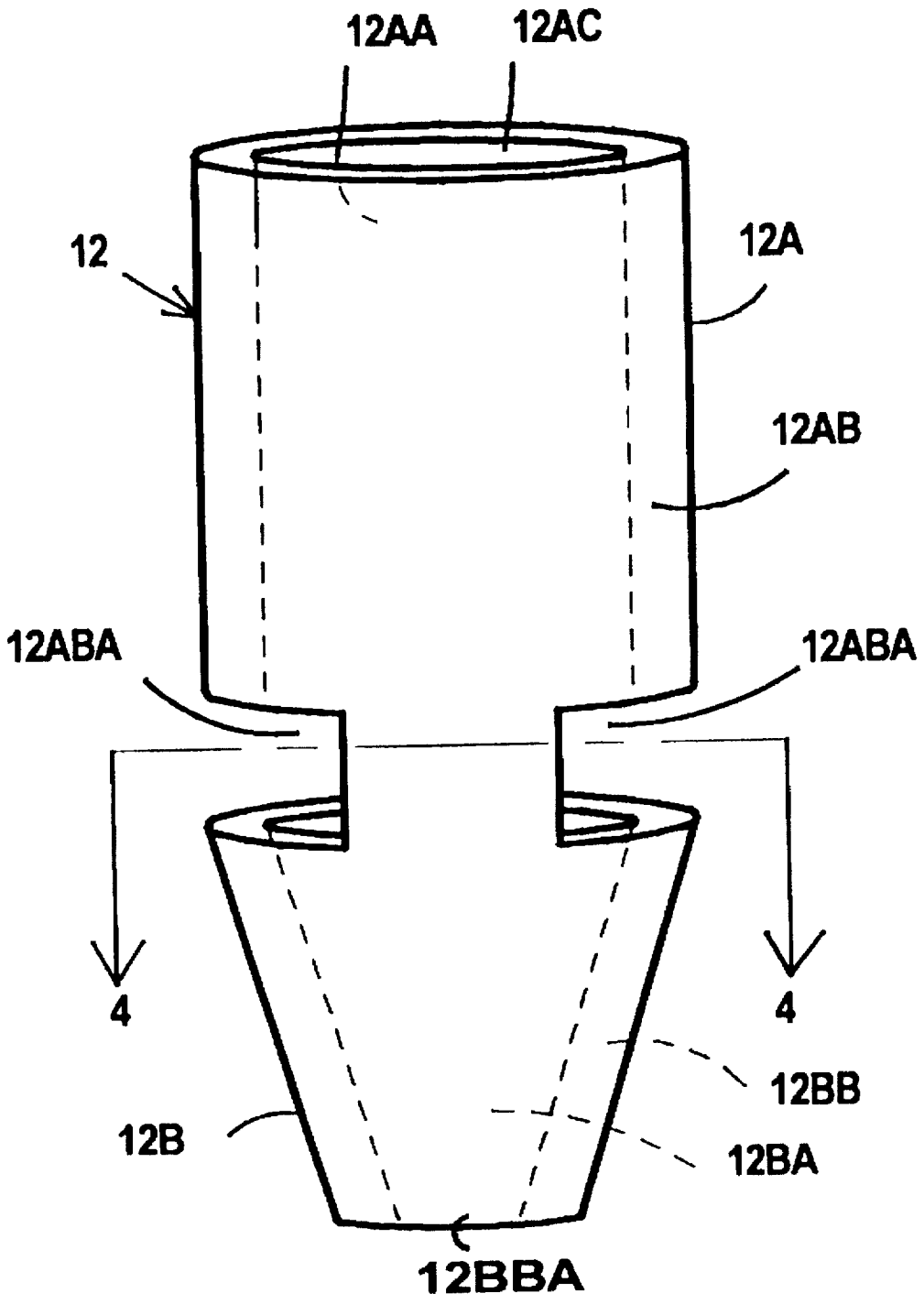
FIG. 3 is a perspective view of the hollow housing.
Figure 4:
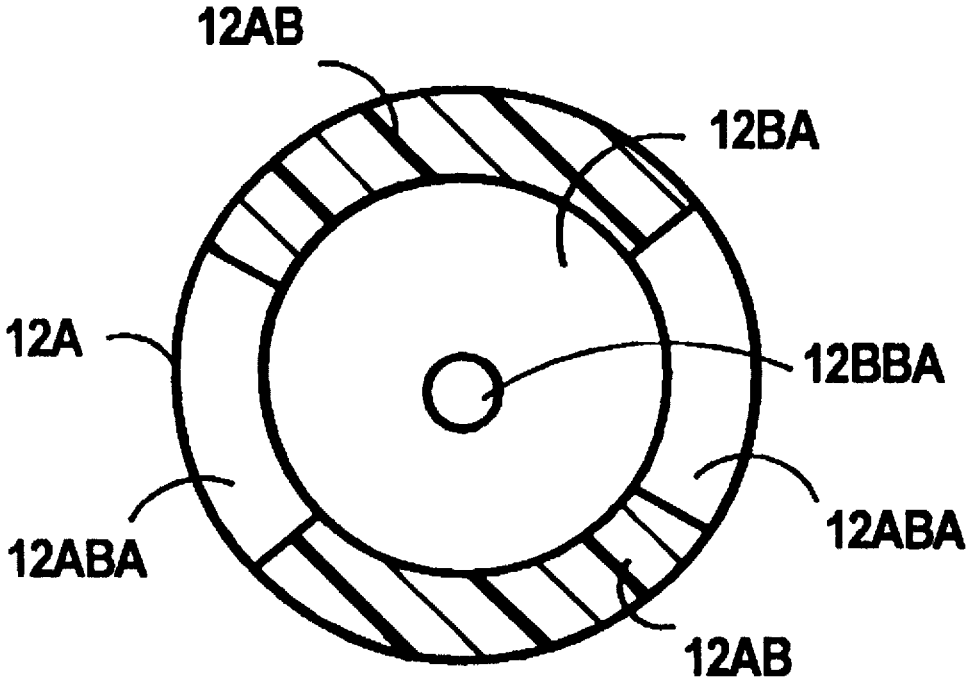
FIG. 4 is a cross sectional view taken along line 4—4 in FIG. 3.

It is to be mentioned that the foregoing description further illustrates the velocity of liquid into the at least hollow main housing upper portion one inflow port 11ABA that is contained in the hollow main housing upper portion wall 11AB of the hollow main housing upper portion 12A of the hollow main housing 12 (see FIG. 3).

Figure 14:
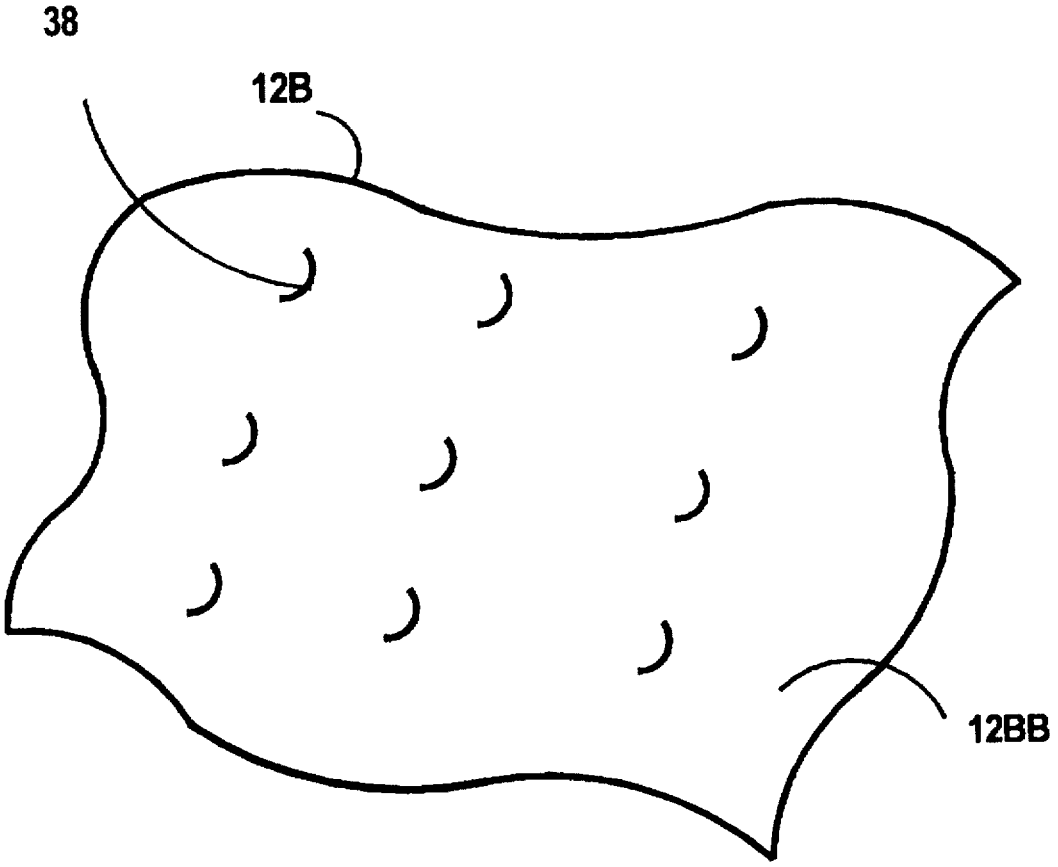
FIG. 14 is a fragmented view showing the counter torque means.

As shown in FIG. 14, counter torque directors 38 are disposed on the interior surface of the hollow main housing lower portion wall 12BB of the hollow main housing lower portion 12B of the hollow main housing 12. The counter torque adaptor 38 increase the thrust in the area of the at least one rotating object 26 by reducing the flow that is in the direction of system torque, affecting high pressure to low pressure leakage around the extremities of the at least one rotating object 26, and shaping the flow as it leaves the at least one hollow main housing lower portion wall outflow port 12BBA that is contained in the hollow main housing lower portion wall 12BB of the hollow main housing lower portion 12B of the hollow main housing 12.

A flotation means 40 (see FIGS. 1 and 2),made of a flotation material, can be applied to the apparatus for aerating and mixing of liquids and gases 10 to maintain it in variable orientations and unrestricted position on the surface on the liquid 11.

Figure 15:
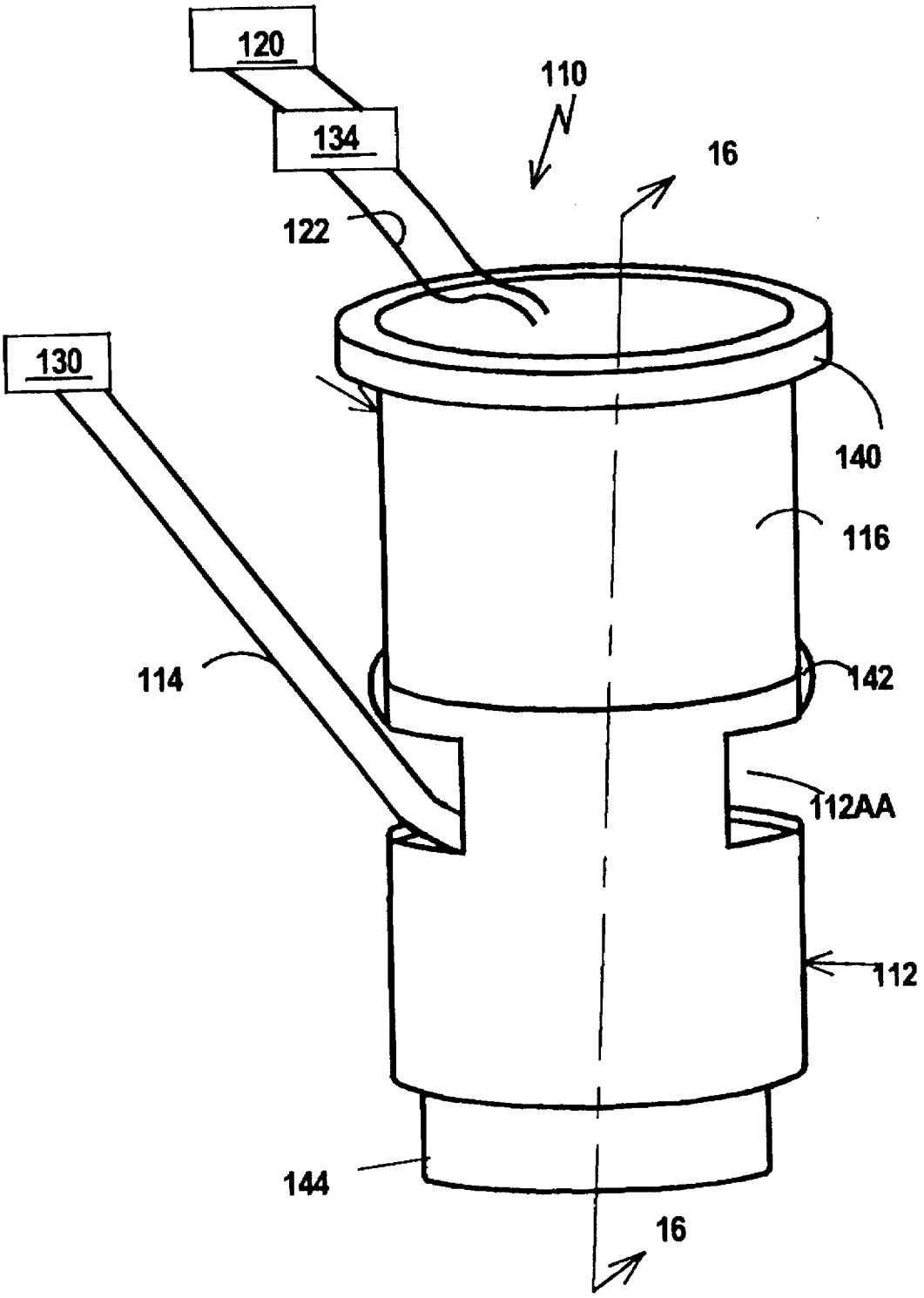
FIG. 15 is a perspective view of an alternative embodiment of the apparatus for aerating and mixing liquids and gases.
Figure 16:
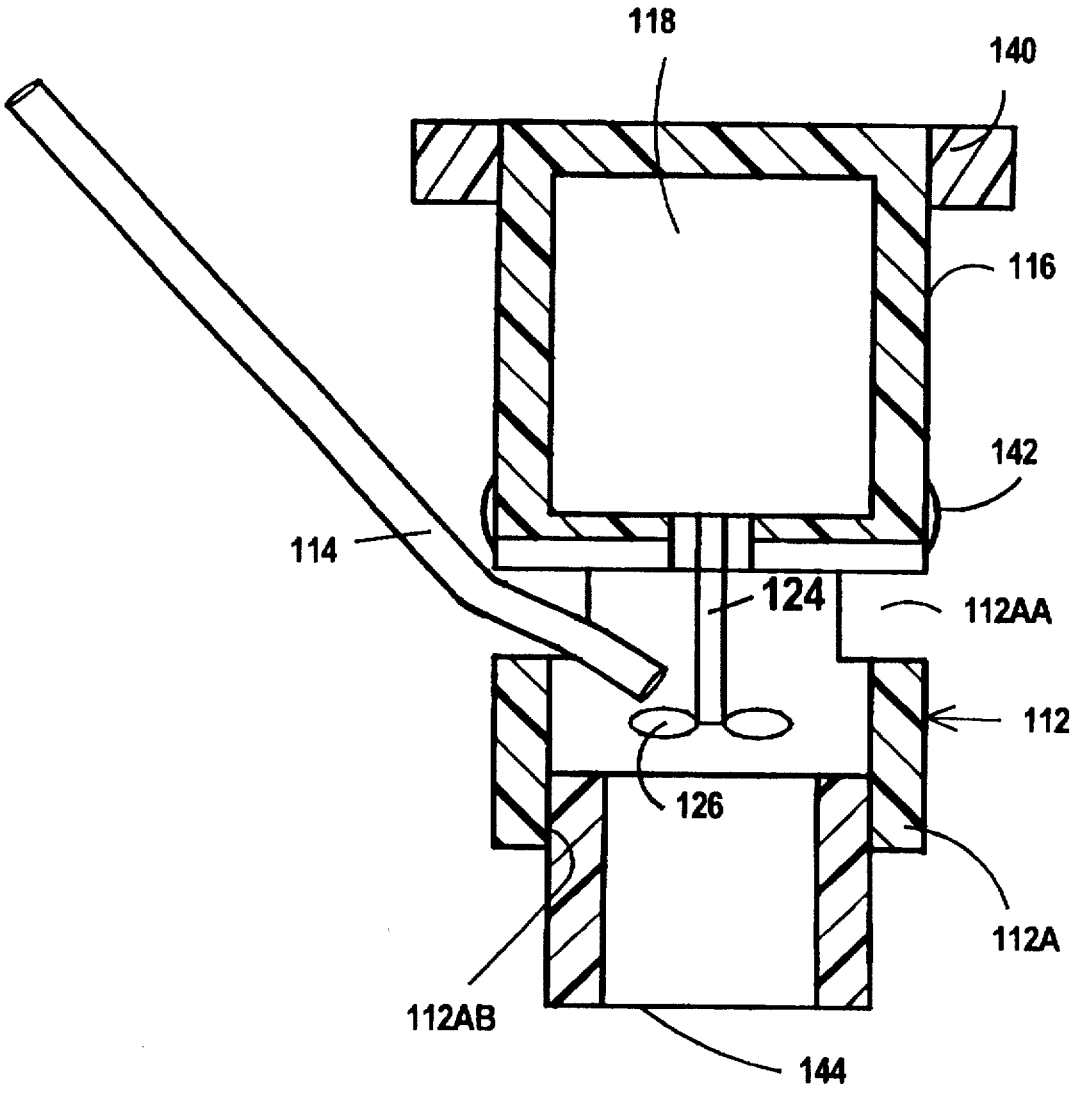
FIG. 16 is a cross sectional view taken along line 16—16 in FIG. 15.

Referring now to FIGS. 15 and 16, an alternate embodiment of the apparatus for aerating and mixing liquids and gases of the present invention is shown generally at 110 and includes a hollow housing 112, at least one conduit tube 114 that is similar to the conduit tube 14, a hollow motor housing 116 which is connected to the hollow housing 112 by an adhesive 142, a motor 118 which is similar to the motor 18, a power supply 120 which is similar to the power supply 20 powers the motor 118, wires 122 that are similar to the wires 22 emanate from the power supply 120 and pass into the hollow motor housing 116, a shaft 124 which is similar to the shaft 24 emanates from and is revolved by the motor 118 and passes through the hollow motor housing 116, and at least one rotating object 126 which is similar to the at least one rotating object 26.

The hollow housing 112 is generally cylindrical in shape, but is not limited to that, and includes a hollow housing wall 112A. At least one hollow housing wall inflow port 12AA and at least one hollow housing outflow port 112AB are contained in the hollow housing wall 112A of the hollow housing 112.

As with the hollow main housing 12, the hollow housing 112, is a multi-function enclosure and is configured so that the geometry of the at least one hollow housing wall inflow port 112AA that is contained in the hollow housing wall 112A of the hollow housing 112 can be varied so that the flow therethrough can be adjusted. The geometry of the at least one hollow housing wall outflow port 112AB that is contained in the hollowing housing wall 112A of the hollow housing 112 can also be varied so that the flow therethrough can be adjusted.

The design of the at least one hollow housing wall inflow port 112AA that is contained in the hollow housing wall 112A of the hollow housing 112, and the design of the at least one hollow housing outflow port 112AB that is contained in the hollow housing wall 112A of the hollow housing 112 is based on the principle that as the speed of a liquid or gas increases the pressure decreases, that is, the speed of the liquid or gas is inversely proportional to the pressure.

It is to be mentioned that the hollowing motor housing 116 may also be designed to communicate coaxially with the hollow housing 112. In this configuration, the hollow motor housing upper portion wall communicates with the at least one hollow housing wall inflow port 112AA of the hollow lower housing 112 and the hollow motor housing portion wall acts to control the inflow characteristics of liquid 11 of FIG. 1.

A coaxial sliding sleeve 144 can be disposed within the hollow housing 112 movable through the at least one hollow housing outflow port 112AB that is contained in the hollow housing wall 112A of the follow housing 12. The coaxial sliding sleeve 144 generally varies the characteristics of the flow patterns flowing into the low pressure side exiting the at least one rotating object 26, 126. It can have the same geometry as the first director fin 16BA and the second director fin 16BB and can therefore represent an adjustable thrust director fin. It can further provide an adjustable horizontal slot for eliminating leakage to the rotating object low pressure side since it closes the distance between the tip of the rotating object 26, 126 and the at least one outflow port 12BBA It is to be mentioned that the coaxial sliding sleeve 144 may be designed into the hollow housing wall 112A of the hollow housing 112, but is not limited to that. The geometry of the coaxial sliding sleeve 144 of the hollow housing wall 112A of the hollow housing 112 may be varied.

It is to be further noted that the conduit 14, 114 must be disposed within the confines of the hollow main housing 12, 112 during low rotation of the at least one rotating object 26, 126 but could be disposed external to the hollow main housing 12, 112 during other operations. The hollow main housing 12, 112 and the motor housing 16, 116 are integrally formed or could be adjustable connected to each other so that they move coaxially to each other. The first thrust director fin 16BA and the second thrust director fin 16BB are integrally formed with the motor housing 16 or could be part of the hollow main housing 12. The plurality of male threads 24AA may also be of a different geometry so that a male thrusting geometry is formed that drives the substance 11 towards the rotating object low pressure side 26A.

In short, the present invention 10, 110 is an apparatus that uses various means, singly or in combination, to provide for mixing of gases and liquids by inducing liquids and gases into another liquid 11 and controlling the quantity and size of the bubbles 36 contained in the mixture and therefore the rates of absorption of the gases into the liquids and mixing of the combinations. The means may include mechanical or electrical, but are not limited to that. A motor 18,118 is used to rotate a shaft 24,124 which may be connect to another shaft on which at least one rotating object 26,126 is attached but is not limited to that.

A housing 12,112 surrounds the at least one rotating object 26,126 and contains at least one inflow port 12ABA, 112AA through which the gases and liquids can enter and which also contains at least one outflow port 12BBA, 112AB through which the gases and liquids can exit. The size of the at least one inflow port 12ABA, 112AA may be adjusted to regulate the flow of the gas and liquid entering the hollow housing 12,112. The size of the at least one outflow port 12ABA, 112AA can also be adjusted to regulate the flow of the gas and liquid leaving the hollow housing 12,112.

The hollow housing 12,112 contains means to control and adjust the flow of the gas and liquid entering the low pressure side 26A of the at least one rotating object 26. The at least one rotating object 26 may be propellers and/or impellers, but is not limited to them. The hollow housing 112 can be fixed directly to the motor 118, by an adhesive 142 or made as a single component, without the capability for adjustment.

The hollow housing 112 and hollow motor housing 116 can be designed coaxially so that various geometries can be adjusted.

At least one conduit tube 14,114 passes through the hollow housing 12,112 and has a distal end 14AA that is in communication with the atmosphere and/or a gas and/or liquid that is to be introduced into the liquid 11. This distal end 14AA may be either open or contain adjustments apparatus 30 for controlling the flow rate of the atmospheric air and/or the gas and/or the liquid enter the at least one conduit tube 14,114. The proximal end 14BA of the at least one conduit tube 14,114 is located in dose proximity to and communicates with the low pressure side 26A of the at least one rotating object 26,126 and is geometrically shaped to enhance the flow rate to and the interaction with the low pressure side 26A of the at least one rotating object 26,126.

To further improve the flow rate to and the interaction with the low pressure side 26A, the at least one conduit tube 14,114 may be rotated through an angle of 360 degrees, and/or it may be moved closer to or farther away from the at least one rotating object 26,126, both in the horizontal and vertical directions. The at least one rotating object can also generate sufficient low pressure so that the at least one conduit tube 14,114 may be located outside the hollow housing 12,112 and the that the liquid and gas can be induced in the stream that flows into the low pressure side 26A of the at least one rotating object 26,126.

However, the need for the at least one conduit tube 14,114 can be eliminated by placing the apparatus 10,110 in an inverted position, but not limited to that, in the liquid 11 so that the gas and/or liquid is drawn into the low pressure side 26A of the at least one rotating object 26,126 and ejected through the at least one outflow port 12BBA, 112AB.

It is to be mentioned that in the inverted position the at least one rotating means can be so configured as to reverse the characteristics of the low pressure side 26A to be a high pressure side 26B and the high pressure side 26B to be a low pressure side 26A with conduit tube 14,114 being placed in the low pressure side of the inverted configuration.

It is to be further mentioned that the conduit means 14 can be used in conjunction with the inverted operation of apparatus 10,110 wherein the characteristics of the low pressure side 26B and high pressure side 26A are reversed. Also that the apparatus 10,110 can be used without the conduit means 14.

The present invention 10,110 may be used for aerating purposes by maintaining the apparatus 10,100 above the surface level of the liquid 11 and utilizing the low pressure of the at least one rotating object 26,126 to draw the gas located at the surface of the liquid 11 into the liquid 11.

It will be understood that each of the elements described above, or two or more together, may also find a useful application in other types of constructions differing from the types described above.

While the invention has been illustrated and described as embodied in an apparatus for aerating and mixing liquids and gases, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

What is claimed as new and desired to be protected by Letters Patent is set forth in the appended claims:

1. An apparatus for aerating and mixing liquids and gases (10), comprising:

A) a hollow housing (12) having a hollow housing first portion (12A) with a hollow housing first portion wall (12AB) containing at least one hollow housing first portion wall port (12ABA) and a hollow housing second portion (12B) with a hollow housing second portion wall (12BB) containing at least one hollow housing second portion wall port (12BBA) connected to the hollow housing first portion (12A);

B) at least one thrust director fin (16BA) disposed in the hollow housing second portion (12B), each of the at least one thrust director fin (16BA) contains at least one horizontally disposed slot that receives each of an at least one rotating object (26) so that leakage between the rotating object high pressure side and the rotating object low pressure side is eliminated;

C) said at least one rotating object (26) disposed in the hollow housing second portion (12B) and having a rotating object low pressure side and a rotating object high pressure side;

D) rotating means for rotating said at least one rotating object (26) is disposed in the hollow housing first portion (12A);

E) a powering means for powering the rotating means;

F) a shaft (24) connecting the at least one rotating object (26) to the rotating means so that upon rotation of the at least one rotating object (26) a substance is drawn to the rotating object low pressure side, the shaft (24) further has an outer surface that has a plurality of male screw type threads disposed thereon and the at least one rotating object has an inner surface that has a plurality of female screw-type threads disposed thereon so that the at least one rotating object can be readily positioned along the shaft (24) and thrust can be directed away from the at least one rotating object (26);

G) a speed regulator means (30) for regulating the speed of rotation of the at least one rotating object (26) wherein the speed regulator means (30) is selected from a group consisting of voltage regulators, current regulators, micro controllers, microprocessors, and digital signal processors;

H) a flow regulator (30) for regulating the flow of the substance entering the rotating object low pressure side;

I) a cleaving means for reducing the size of gas bubbles (36) leaving the rotating object high pressure side; and J) at least one adjustably positioned conduit tube (14) passing through at least one hollow housing first portion wall port (14ABA) and having a conduit tube first end (14AA) disposed external to the hollow housing (12) and a conduit tube second end (14BB) disposed in the rotating object low pressure side.

2. The apparatus (10) as defined in claim 1, wherein the substance is selected from a group consisting of liquid, gas, and atmospheric air.

3. The apparatus (10) as defined in claim 1, wherein the hollow housing first portion (12A) has a shape that is selected from a group consisting of cylindrical, rectangular, square, conical, elliptical, and spherical.

4. The apparatus (10) as defined in claim 1, wherein the hollow housing second portion (12B) has a shape that is selected from a group consisting of cylindrical, conical, spherical, elliptical, square, and conical tapering away from the hollow housing first portion (12A).

5. The apparatus (10) as defined in claim 1, wherein the at least one rotating object (26) is selected from a group consisting of a propeller and an impeller.

6. The apparatus (10) as defined in claim 1, wherein the rotating means is selected from a group consisting of an electrical motor and a mechanical motor.

7. The apparatus (10) as described in claim 1, wherein the powering means is selected from a group consisting of AC and DC.

8. The apparatus (10) as described in claim 7, wherein the DC powering means is selected from a group of energy storage devices.

9. The apparatus (10) as described in claim 1, wherein the cleaving means is disposed at a position selected from a group consisting of at least one hollow housing first portion wall port and at the at least one hollow housing second portion wall port (12BBA).

10. The apparatus (10) as described in claim 9, wherein the cleaving means is selected from a group consisting of a screen (32) and aperture material.

11. The apparatus (10) as described in claim 1, further comprising a coaxial sliding sleeve mounted in the hollow housing second portion (12B) and movable through the at least one hollow housing second portion wall port (12BBA).

12. The apparatus (10) as described in claim 1, further comprising feedback means for directing gas bubbles (36) leaving the at least one hollow housing second portion wall port (12BBA) to enter the at least one hollow housing first portion wall port (12ABA).

13. The apparatus (10) as described in claim 1, wherein the hollow housing first portion (12A) and the hollow housing second portion (12B) are disposed coaxially.

14. The apparatus (10) as described in claim 1, wherein the at least one adjustably positioned conduit tube second end (14BB) is disposed proximate to the at least one hollow housing first portion wall (12AB).

15. The apparatus (10) as described in claim 1, wherein the at least one adjustably positioned conduit tube second end (14BB) is disposed proximate to the at least one hollow housing first portion wall port (12ABA).

16. The apparatus (10) as described in claim 1, wherein the at least one hollow housing first portion wall port (12ABA) geometry is adjustable.

17. The apparatus (10) as described in claim 1, wherein the at least one hollow housing second portion wall port (12BBA) geometry is adjustable.

18. The apparatus (10) as described in claim 1, further comprising gas current damper means for eliminating affects of ambient gas currents and turbulence.

19. The apparatus (10) as described in claim 1, wherein the at least one thrust director fin (16BA) has geometries which are adjustable.

20. The apparatus (10) as described in claim 1, wherein at least one horizontally disposed slot has geometries which are adjustable.

21. The apparatus (10) as described in claim 1, further comprising a coaxial sliding sleeve slidably mounted in the at least one hollow housing second portion wall port (12BBA).

22. The apparatus (10) as described in claim 1, further comprising at least one thrust director with adjustable geometry.

23. The apparatus (10) as described in claim 1, further comprising counter torque means (38) for minimizing affects of the at least one rotating means.

24. The apparatus (10) as described in claim 1, further comprising screening means disposed at the hollow housing first portion wall port (12ABA).

25. The apparatus (10) as described in claim 1, further comprising filtering means disposed at the hollow housing first portion wall port (12ABA).

26. The apparatus (10) as described in claim 1, further comprising an extension shaft (24) that connects the at least one rotating object to the shaft (24) to the rotating means.

* * * * *